US008806687B1

(12) United States Patent
Houry

(10) Patent No.: US 8,806,687 B1
(45) Date of Patent: Aug. 19, 2014

(54) CRIB

(75) Inventor: Robert L. Houry, Willowick, OH (US)

(73) Assignee: Foundations Worldwide, Inc., Medina, OH (US)

( * ) Notice: Subject to any disclaimer, the term of this patent is extended or adjusted under 35 U.S.C. 154(b) by 278 days.

(21) Appl. No.: 13/268,249

(22) Filed: Oct. 7, 2011

Related U.S. Application Data

(60) Provisional application No. 61/507,918, filed on Jul. 14, 2011.

(51) Int. Cl.
*A47D 15/00* (2006.01)

(52) U.S. Cl.
USPC ..... 5/663; 5/93.1; 248/345.1

(58) Field of Classification Search
USPC ..... 5/93.1, 99.1–102, 663, 946; 52/288.1; 206/586; 248/345.1
See application file for complete search history.

(56) References Cited

U.S. PATENT DOCUMENTS 2,650,371 A * 9/1953 Showalter ..... 5/11
4,365,839 A * 12/1982 Strassle ..... 297/411.2
4,817,902 A * 4/1989 Mason ..... 248/345.1
4,988,083 A * 1/1991 Bradley ..... 267/140
5,771,646 A * 6/1998 DeSouza ..... 52/263
D410,381 S 6/1999 Johnson, III
D412,436 S * 8/1999 Tsui ..... D8/403
6,354,049 B1 * 3/2002 Bennett ..... 52/287.1
6,467,108 B1 * 10/2002 Wang ..... 5/99.1
D579,696 S 11/2008 Houry
D590,194 S 4/2009 Houry et al.
D595,073 S 6/2009 Houry et al.
7,568,244 B1 8/2009 Shamie et al.
7,841,814 B2 * 11/2010 Miller ..... 410/47
D628,879 S 12/2010 Kindig
7,917,976 B1 4/2011 Shamie et al.
D661,121 S 6/2012 Houry et al.
D661,138 S 6/2012 Lytle
D666,470 S 9/2012 Biter et al.

* cited by examiner

*Primary Examiner* — Nicholas Polito
(74) *Attorney, Agent, or Firm* — Brett A. Schenck; Walker & Jocke

(57) ABSTRACT

A crib is provided that includes a mattress support portion, a horizontal member and a vertical member. The horizontal member may correspond to a portion of a front or back wall of the crib. The vertical member may correspond to a post adjacent the horizontal member, which vertical member includes an upper end that extends above the mattress support portion and a lower end that extends below the mattress support portion. The crib may also include at least one bumper mounted with a fastener that connects the vertical member to the horizontal member of the crib.

20 Claims, 24 Drawing Sheets

CRIB

CROSS-REFERENCE TO RELATED APPLICATIONS

This application claims benefit under 35 U.S.C. §119(e) of Provisional Application Ser. No. 61/507,918 filed Jul. 14, 2011, the disclosure of which is incorporated herein by reference in its entirety.

BACKGROUND

A crib is designed to hold a child therein. Cribs for children typically include a mattress surrounded by walls that are sufficiently high to prevent a child from falling or climbing out of the crib. The walls of the crib may be comprised of vertical slats, rails, posts, boards, and any other elements operative to form a barrier that keeps a child within the interior space of the crib.

There is a need for improvement to existing cribs.

SUMMARY

The following is a brief summary of subject matter that is described in greater detail herein. This summary is not intended to be limiting as to the scope of the claims.

Described herein are various technologies relating to cribs which enable an adult to more easily and safely move a child into and out of the crib. Also described herein are various technologies which enhance the durability and strength of the crib, such as when the crib is used to move children during emergency evacuations.

In an example embodiment, a crib may have at least one wall that bounds an interior space operative to support a mattress therein. The at least one wall may include a pivoting drop gate that is in hinged connection with a stationary portion of the wall.

The drop gate may include opposed side ends. A hinge may be mounted between the stationary portion and the drop gate and may be configured to enable the drop gate to pivot relative to the stationary portion between an upper closed position and a lower open position. The crib may also include at least two vertical members (such as posts) respectively positioned adjacent opposed side ends of the drop gate when the drop gate is in the closed position.

This described example of a crib may include at least one latch device in operative connection with at least one of the side ends of the drop gate (or alternatively in connection with the vertical member). In addition the crib may include at least one striker plate in operative connection with at least one of the vertical members (e.g., posts) (or alternatively in connection with the side ends of the drop gate). The latch device is operative to engage with the at least one striker plate to maintain the drop gate in the closed position. Also, the latch device is operative to disengage from the striker plate and enable the drop gate to pivot to the open position.

In this described example, at least one of the hinge and the striker plate are operative to include at least one cavity therein such that when the drop gate is moved to the closed position, a finger of a child placed adjacent at least one portion of the hinge or the striker plate, may be urged into the at least one cavity. This cavity is sufficiently large to prevent pinching of the finger by portions of the crib when the drop gate is closed.

For example, with respect to the hinge, when the drop gate is in the closed position, the hinge forms a shape having the cavity therein. The hinge may include a pivot axis about which the drop gate pivots with respect to the stationary portion of the wall of the crib. When the drop gate is in the closed position, the cavity of the hinge has a height that is sufficiently large to enable a finger of a child to extend into the at least one cavity of the hinge to be adjacent the pivot axis, without being pinched by the hinge.

With respect to the striker plate, the striker plate may include a projection within the cavity in the striker plate. In this example, the latch device may include a stop surface that is operative to contact the projection and prevent pivoting of the drop gate into the interior space of the crib. Also, in this example, the cavity in the striker plate may include sufficiently large spaces above and below the projection to receive a finger of a child therein without the finger being pinched by the stop surface.

In another exemplary embodiment (which may or may not include the previously described pivoting drop gate), a crib is provided that includes a mattress support portion and a plurality of vertical members (e.g. posts). Each vertical member includes an upper end that extends above the mattress support portion and a lower end that extends below the mattress support portion. The crib further includes casters that are each operatively connected to the lower end of each respective vertical member, and first reinforcing members (e.g. a gussets) that are each operatively connected to the mattress support portion and each respective caster.

In another exemplary embodiment (which may or may not include the previously described pivoting drop gate and first reinforcing members), a crib is provided that includes a wall, a vertical member, and a bumper. The wall, bumper, and vertical member are operatively connected to each other by at least one fastener. The fastener extends into the wall, bumper, and vertical member.

Other aspects of embodiments described herein will be appreciated upon reading and understanding the attached figures and description.

DETAILED DESCRIPTION

Figure 1:
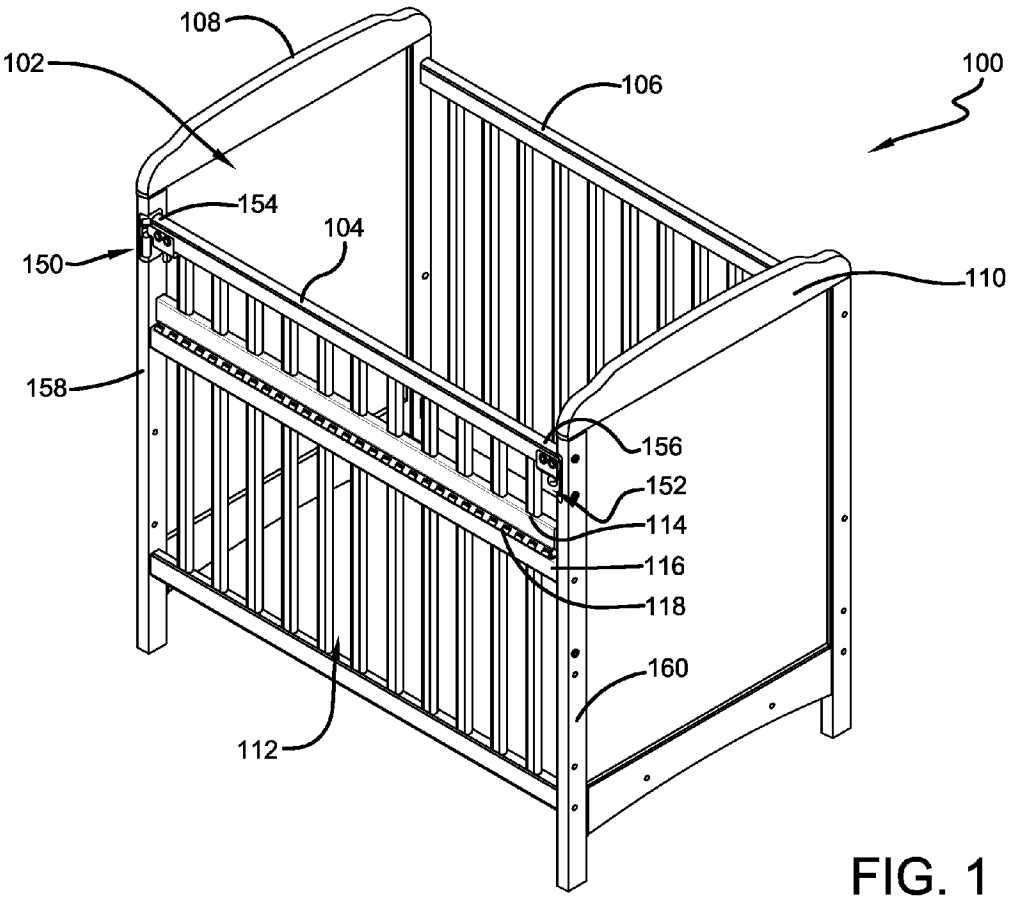
FIG. 1 is an upper perspective view of an example embodiment of a crib that includes a drop gate in an upper closed position.

Various technologies pertaining to cribs will now be described with reference to the drawings, where like reference numerals represent like elements throughout. In addition, several functional block and schematic diagrams of example devices are illustrated and described herein for purposes of explanation. However, it is to be understood that functionality that is described as being carried out by certain components, members, and devices may be performed by multiple components, members, and devices. Similarly, for instance, a component/member/device may be configured to perform functionality that is described as being carried out by multiple components/members/devices.

With reference to FIG. 1, an example embodiment of a crib 100 for use with a child (e.g., a baby or toddler) is illustrated. The crib includes an interior space 102 that is bounded by four walls 104, 106, 108, 110. A bottom portion 112 of the interior of the crib may include slats, a board, frame, and/or other types of support members that are capable of supporting a mattress. The walls of the crib may be comprised of vertical slats, rails, posts, boards, and any other elements operative to form a barrier that keeps a child within the interior space. These described elements of the crib may be made out of materials such as wood, plastic, metal, and combinations thereof and/or other materials operative to form a barrier. Also one or more of these described elements of the crib may be integrally formed and/or may be fastened together via fasteners (e.g., screws, bolts, clips, adhesives).

Figure 2:
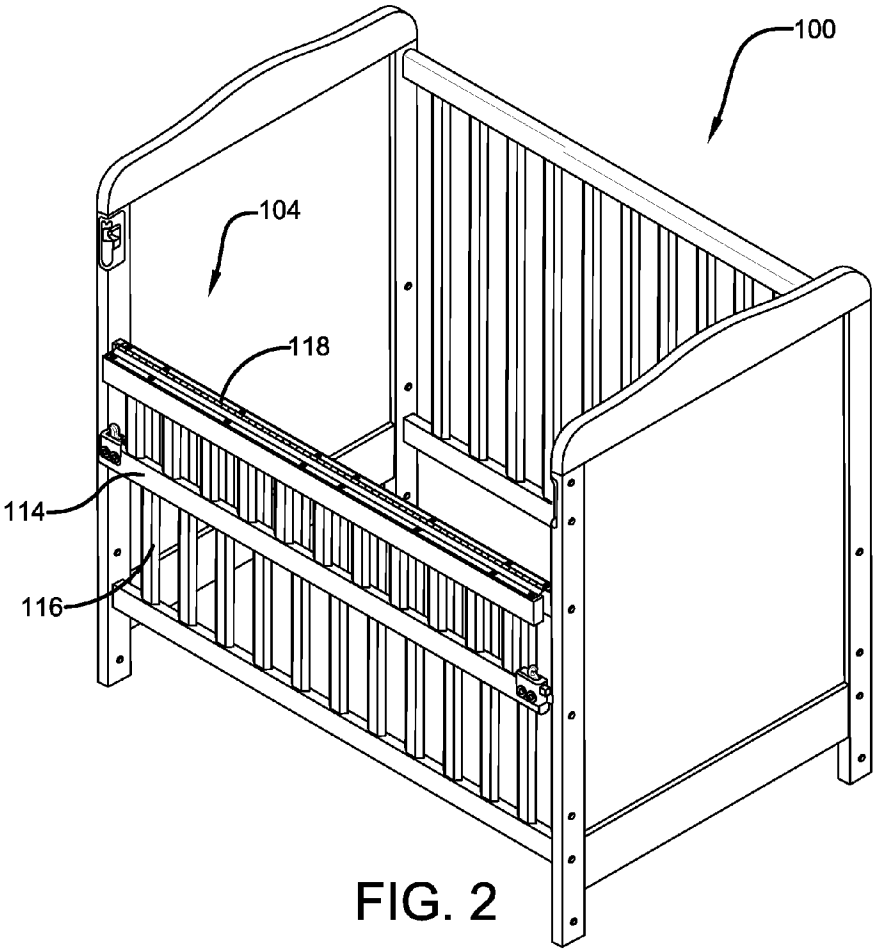
FIG. 2 is an upper perspective view of the example crib in which the drop gate is in the lower open position.

In an example embodiment, at least one wall of the crib may include a pivoting drop gate. In the example shown in FIG. 1, the front wall 104 includes a drop gate 114 which is in an upper closed position. As illustrated in FIG. 2, the drop gate 114 is operatively configured to pivot downwardly with respect to a lower stationary portion 116 of the wall 104, from the upper closed position (shown in FIG. 1) to a lower open position (shown in FIG. 2). In the lower open position of the drop gate 114, the height of the wall 104 is shorter. As a result, an adult may more easily move a child into and out of the crib over the shorter wall. Also, it should be appreciated that in alternative embodiments, additional walls of the crib may include a drop gate. For example, in a further alternative embodiment, both the front and back walls 104, 106 may include drop gates.

In example embodiments, the drop gate includes features which minimize harm to a child in the crib (as well as to adults outside the crib). For example, to enable the drop gate 114 to pivot relative to the lower stationary portion 116, the crib may include at least one hinge 118 positioned between the drop gate 114 and the stationary portion of the wall. Such a hinge may correspond to at least one elongated piano hinge or one or more of any other type of hinges that are capable of enabling the drop gate to pivot with respect to the stationary portion of the wall.

Figure 3:
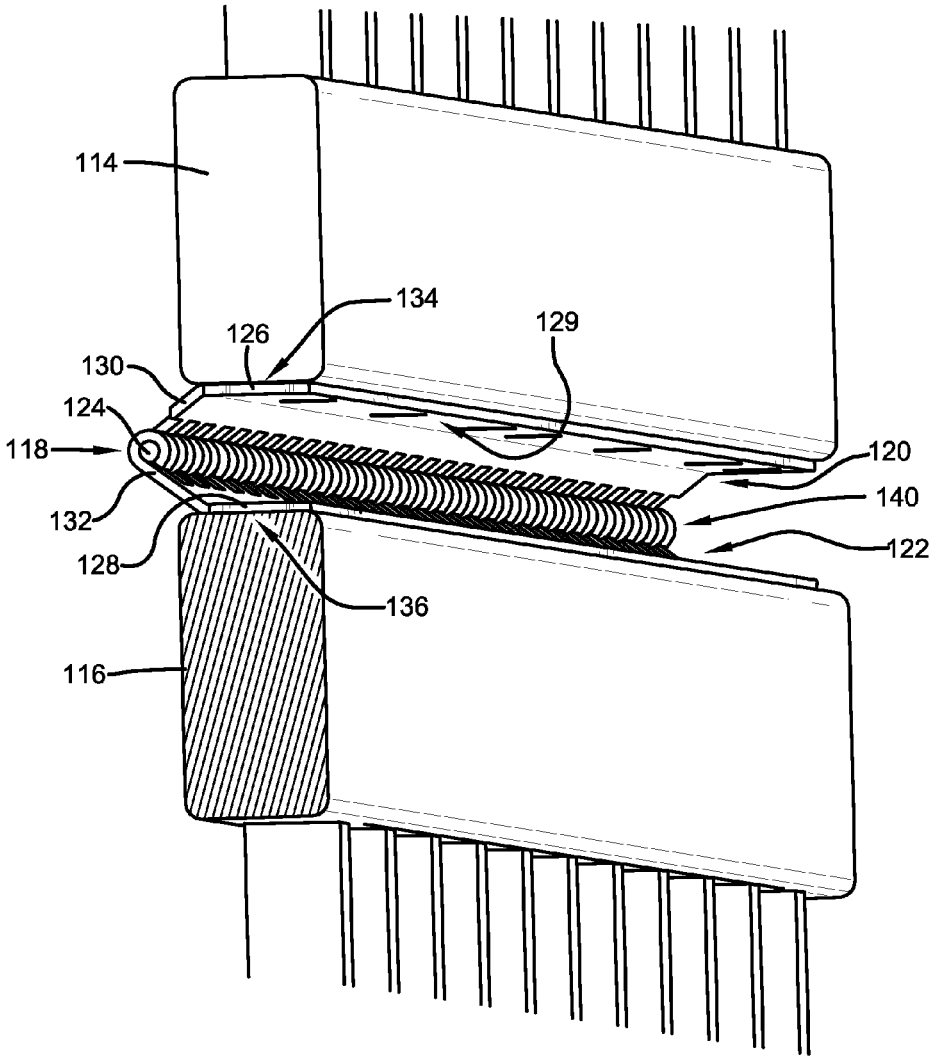
FIG. 3 is a perspective view of an example embodiment of an inside portion of the drop gate in the upper closed position.
Figure 4:
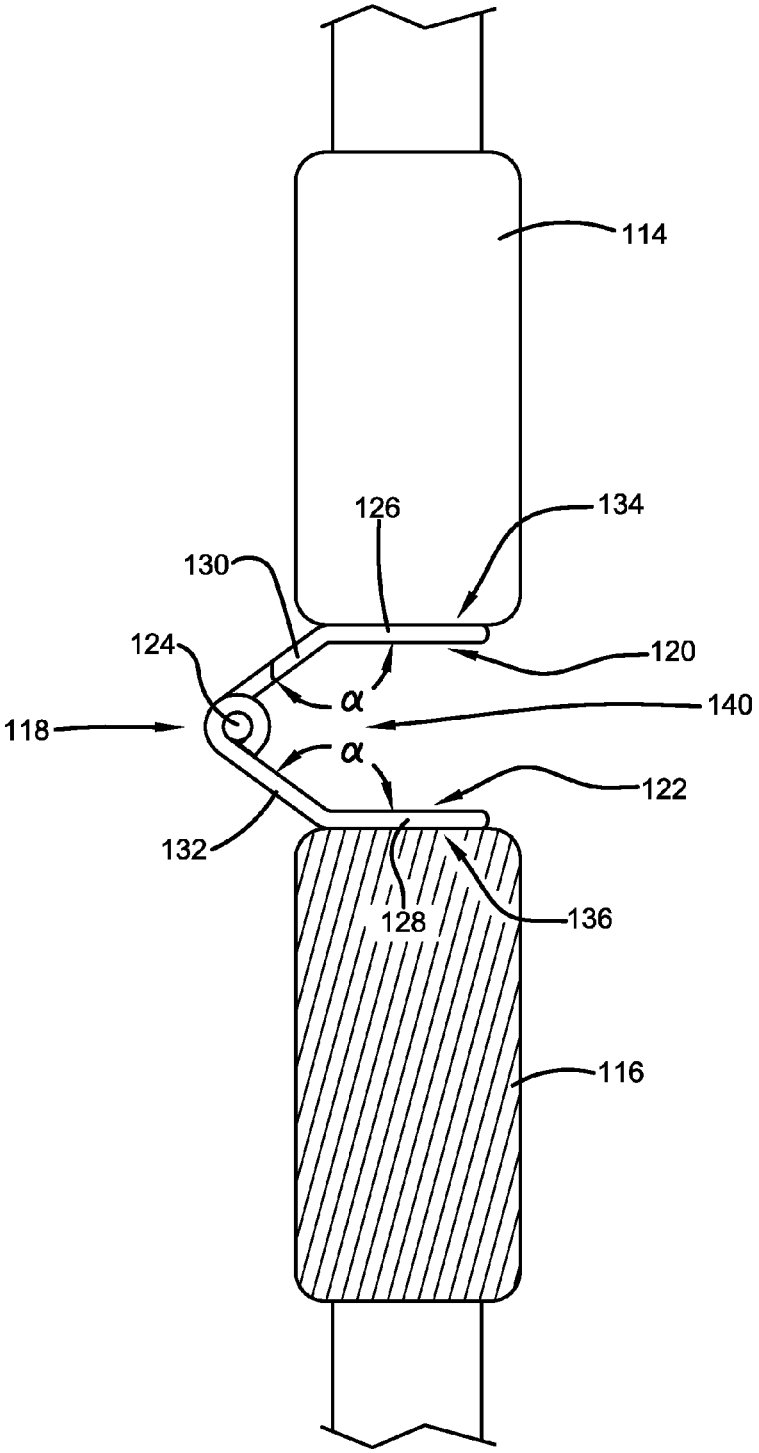
FIG. 4 shows a cross-sectional view of an example embodiment of the drop gate in the upper closed position.

As shown in FIG. 2, (with the drop gate in the lower open position), a child may be able to place their fingers on top of the opened hinge 118. As the drop gate is moved to the upper closed position shown in FIG. 1), an example embodiment of the hinge 118 may be configured to move into a C-shaped form (as illustrated in FIGS. 3 and 4) or other shape, which provides a cavity 140 therein with sufficient space for fingers to extend therein to the back of the hinge without being pinched in the hinge. Thus, when the drop gate is moved to the closed position, fingers resting on top of the hinge will not be pinched. Rather the drop gate may push the fingers away from the hinge 118, and/or may push the fingers into the cavity 140 of the C-shaped form of the hinge.

As illustrated in FIG. 3 (an inside perspective view) and FIG. 4 (a cross-sectional plan view), the hinge 118 includes an angled first hinge member 120 and an angled second hinge member 122. These first and second hinge members include mounted ends 126, 128 that are respectively attached via fasteners 129 (e.g., screws, bolts, nails, barbed projections, and/or other fasteners) to the corresponding ends 134, 136 of the drop gate 114 and stationary portion 116. As shown in FIG. 4, the mounted ends 126, 128 are generally orientated horizontally when the drop gate is in the upper closed position.

In addition the first and second hinge members 120, 122 also include pivot ends 130, 132 that are joined together in operatively pivoting connection at a pivot axis 124. Such a pivot axis 124 may include a shaft or other pivot member about which the first and/or second hinge members 120, 122 rotate with respect thereto.

To produce the C-shaped form (in the closed position of the drop gate), the pivot ends are bent (with respect to the mounted ends) so as to place the pivot axis 124 both between and vertically disposed away from each of the mounted ends 126, 128. This configuration places the mounted ends 126, 128 in spaced apart relation in a vertical direction and forms the cavity 140 therein.

This described cavity 140 formed by the C-shaped form of the hinge, has a sufficient height to enable a human finger of at least a child (and/or an adult) to extend therein to the pivot axis 124 without being pinched (e.g., compressed). For example, the cavity may have a height from 1 to 2 cm. However, it should be appreciated that in alternative embodiments, the gap may have other sizes and shapes depending on the expected finger sizes of the children and/or adults that may come in contact with the hinge 118.

In an example embodiment, each of the first and second hinge members 120, 122 are bent such that the mounted and pivot ends are orientated with respect to each other at an oblique angle a that is less than 180 degrees and greater than 90 degrees (on the side of the hinge facing toward an interior of the crib when the drop gate is in the closed position). Also it should be appreciated that the bent portion of the first and second hinge members between the mounted end and the pivot end may be sharp (e.g., pointed bend) or relatively more gradual (e.g., rounded/curved bend).

Figure 5:
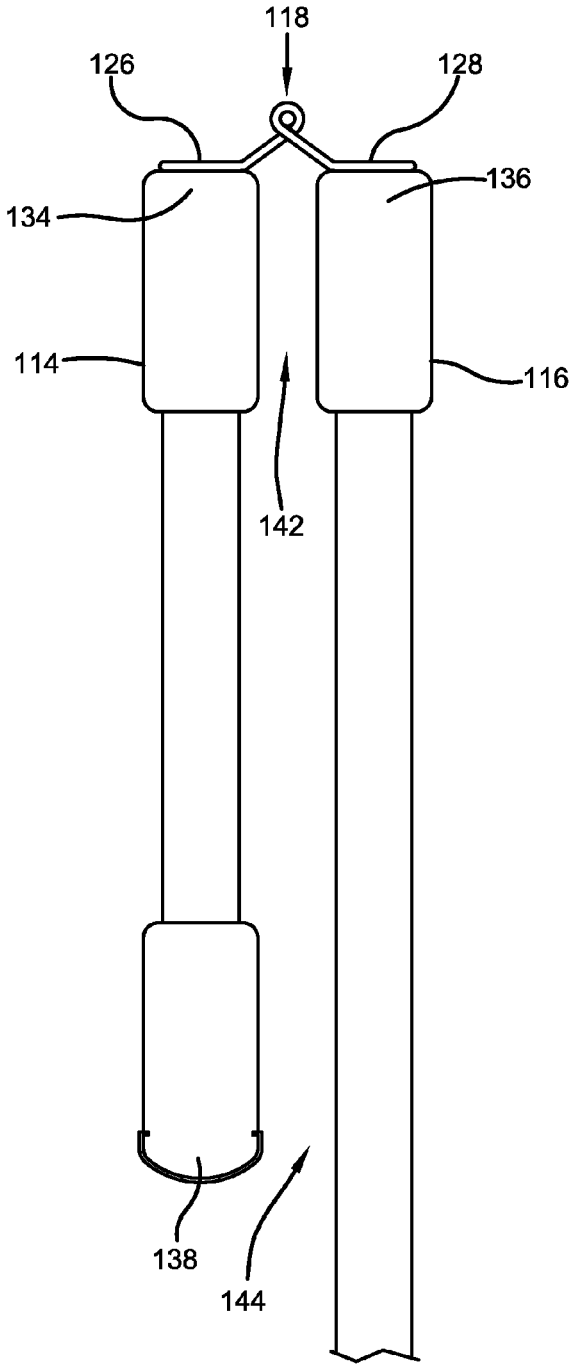
FIG. 5 shows a cross-sectional view of an example embodiment of the drop gate in the lower open position.

FIG. 5 shows a cross-sectional view of the hinge 118 when the drop gate 114 is in the lower open position. In this orientation of the hinge 118, the mounted ends 126, 128 of the hinge are spaced apart in a horizontal direction. As a result the end 134 of the drop gate 114 (that is mounted to the hinge 118) is spaced apart in a horizontal direction from the end 136 of the stationary portion 116 of the wall (that is mounted to the hinge 118). Also, a gap 142 is formed between the drop gate 114 and stationary portion 116 that has a sufficient width to enable a human finger of at least a child (and/or an adult) to extend therein without being pinched when the drop gate is lowered. This gap 142 may extend vertically downwardly from the hinge 118. However, in example embodiments (depending on the size of the hinge and the length of the drop gate) the gap 142 may not extend along the entire length of the drop gate 114. For example, gravity may pull the drop gate 114 into an orientation that tilts the opposed end 138 (e.g., a hand rail) of the drop gate 114 inwardly (relative the vertical direction) to be nearer and/or to contact the side surfaces 144 of the stationary portion of the wall. However, even though in some embodiments the gap 142 may narrow toward the handrail 138 of the drop gate, as can be appreciated, the formation of the gap via the described orientation of the hinge 118, minimizes pinching of fingers for at least a portion of the length of the drop gate 114 when it is in the lower open position.

Referring back to FIG. 1, an example embodiment of the crib may include further features that are operative to reduce the opportunity for fingers of a child or adult from being pinched by the closing of the drop gate. For example, an example embodiment of the crib 100 may include two latch devices 150, 152 on opposed side ends 154, 156 of the drop gate 114 and adjacent portions of vertical members 158, 160 that bound the opposed side ends 154, 156 of the drop gate. As shown in FIG. 1, such vertical members 158, 160 may correspond to posts and/or side ends of the side walls 108, 110 of the crib. However, it should be appreciated that in alternative embodiments, the drop gate 114 may have a width that is less than the stationary portion 116. In such an embodiment, the vertical members that bound the side ends 154, 156 of the drop gate may correspond to portions of the front wall 110 (such as posts) that extend upwardly from the stationary portion 116 of the front wall 104.

Figure 6:
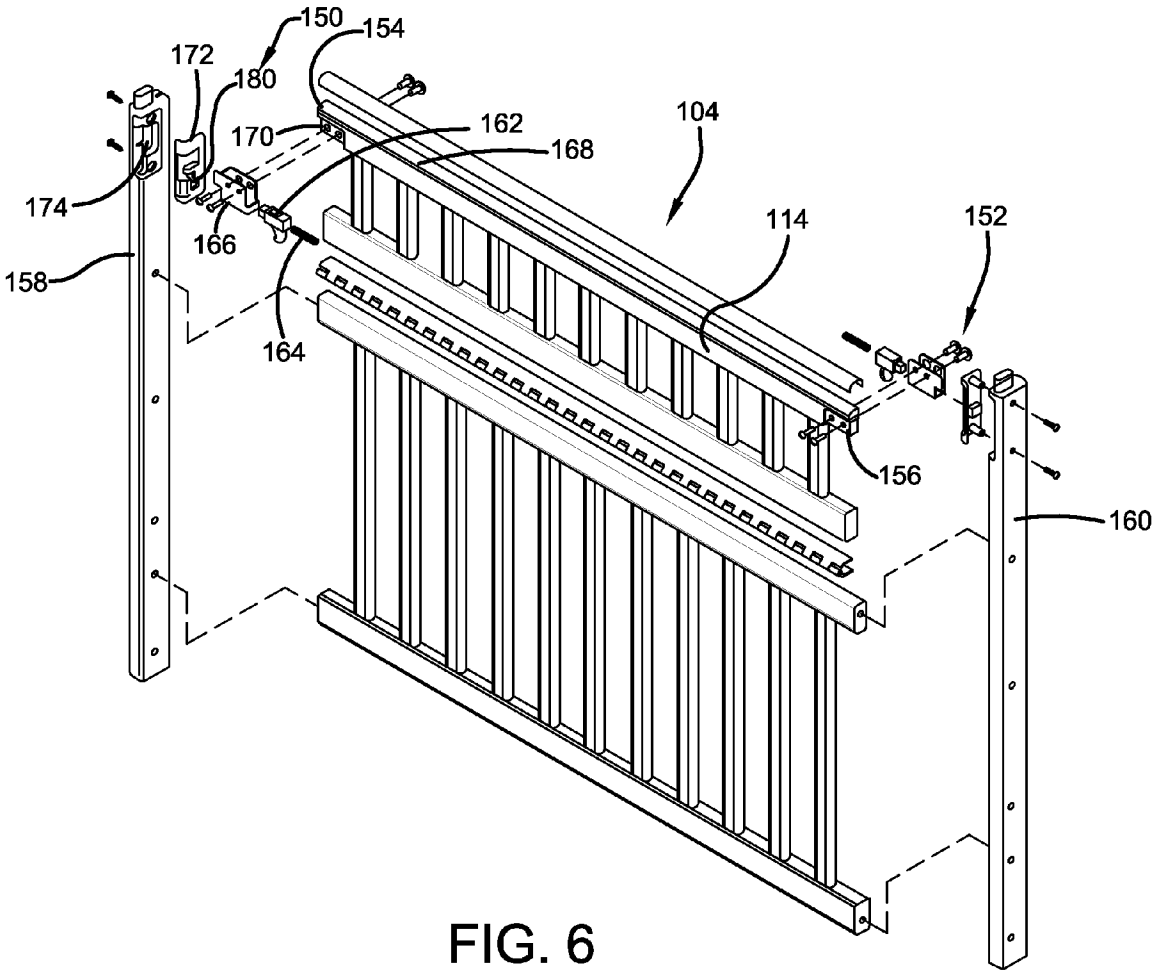
FIG. 6 shows an exploded view of a portion of an example embodiment of the crib.

FIG. 6 shows an exploded view of the front wall 104 and vertical members 158, 160 of the crib. Here the elements of the latch device 150 are discussed. However, it is to be understood that corresponding elements are included in latch device 152. In an example embodiment, the latch device 150 may include a bolt 162 in movable connection with the side end 154 of the drop gate 114. Such a bolt may be biased (e.g., via a spring 164 or other biasing device) to urge the bolt 162 to move outwardly from the side end 154 of the drop gate into engagement with the vertical post 158.

In order to mount the bolt 162 in movable relation with the side end 154 of the drop gate 114, the crib may include a bracket 166 mounted to the side end 154 of the drop gate (via screws, bolts or other fasteners). The bracket 166 may include a cavity therein for receiving the bolt 162 in sliding engagement therein and in sliding engagement relative to the side end 154 of the drop gate.

In the example embodiment of the crib shown in FIG. 6, the described side end 154 may correspond to the ends of an upper hand rail 168 of the drop gate. Such an upper handrail may be comprised of wood, plastic, or other material that is cut (or otherwise formed) to include recesses 170 on either side of the handrail. The recesses may have a sufficient size and shape to receive the bracket 166 mounted therearound such that outer vertical surfaces of the bracket are substantially flush with outer vertical surfaces of the handrail. However, it should be appreciated that in alternative embodiments, the side end of the crib may include a bracket that mounts the bolt in different locations, and/or configurations with respect to the side end 154 of the drop gate.

In an example embodiment, the vertical member 158 may be comprised of wood, plastic, or other material that is cut (or otherwise formed) to include a recess 174. The recess 174 in the vertical member 158 may have a sufficient size and shape to receive a striker plate 172 mounted therein. Such a striker plate may be comprised of a durable material such as brass, stainless steel or other metal or material.

Figure 7:
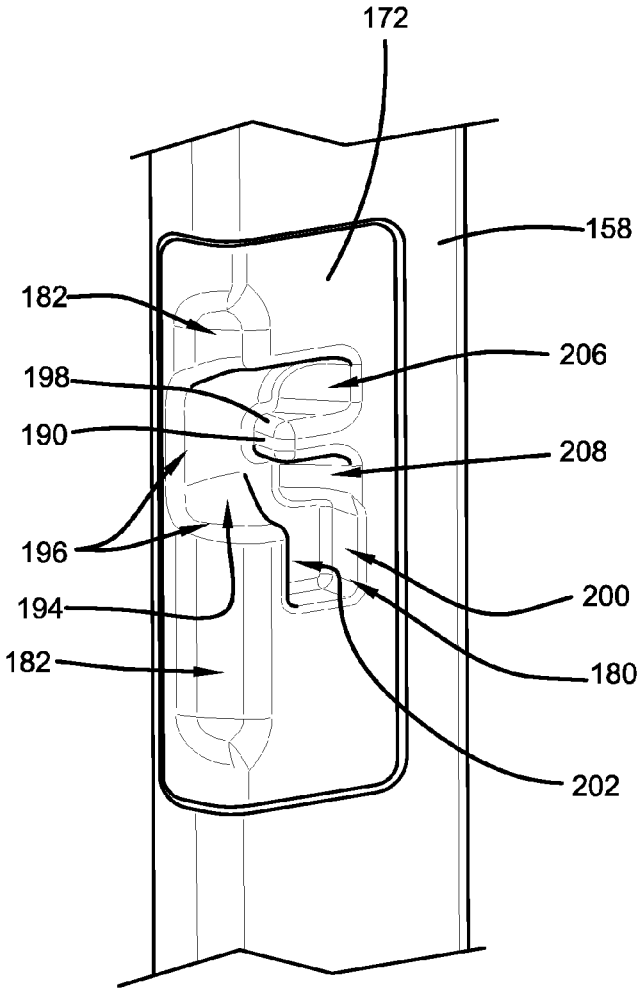
FIG. 7 shows a perspective view of an example embodiment of a striker plate of the crib.

As shown in FIG. 7, the striker plate may include a cavity 180 which is operative to receive an end of the bolt therein (when the drop gate is in the upper closed position). The striker plate may also have a vertical beveled edge surface 182 (e.g., which is chamfered, sloped or and/or rounded) positioned on a forward vertical edge of the vertical member 158. When the drop gate is moved from the lower open position (shown in FIG. 2) to the upper closed position (shown in FIG. 1), the described bolt is operative to slide along and against the lower beveled edge surface 182 and be pushed inwardly (i.e., into the described bracket). When the drop gate reaches its closed position, the bolt will be allied with the cavity 180 and be pushed therein via the spring.

It should be appreciated that if a finger or hand of a child is placed on the striker plate when the drop gate is closed, the beveled edge surface 182 may be operative to minimize injuries by eliminating sharp edges where a finger or hand may be caught. The vertical member 158 above and/or below the striker plate may also include a corresponding beveled edge.

Figure 8:
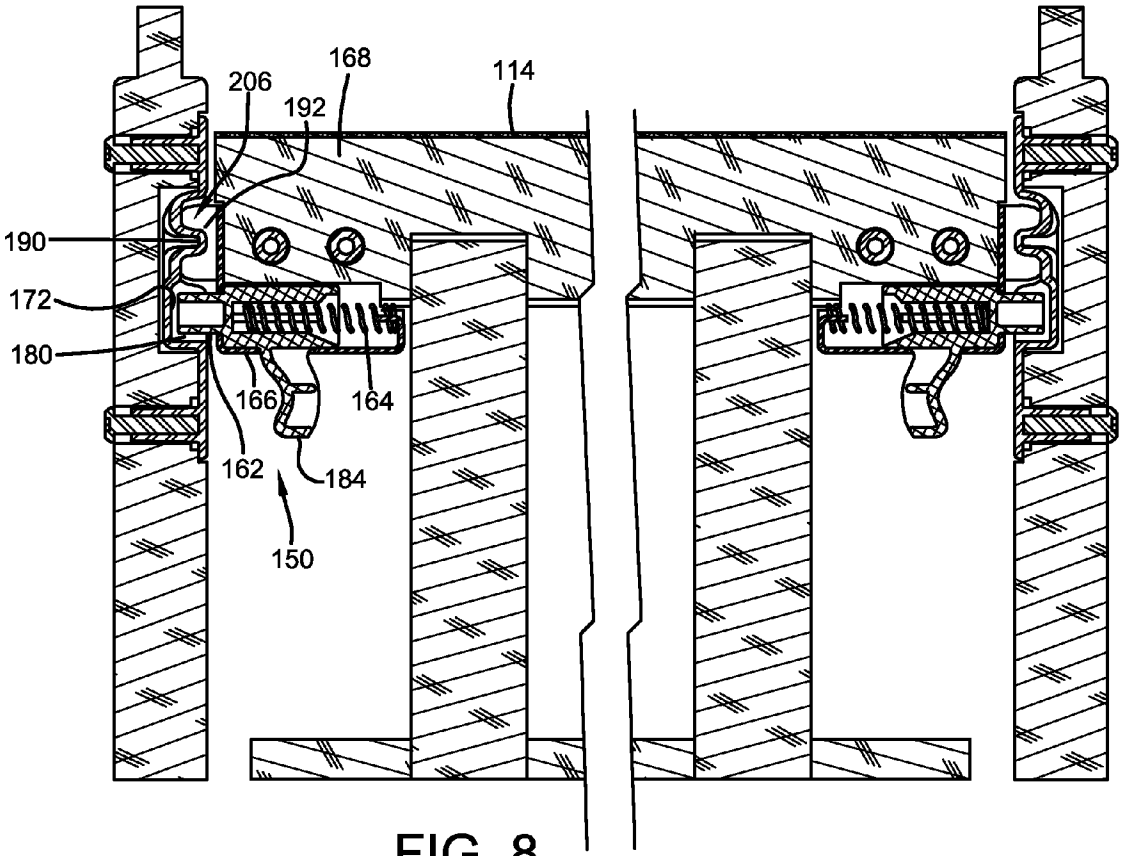
FIGS. 8-9 show cross-sectional views of an example embodiment of a latch device and the striker plate of the crib.

FIG. 8 shows a cross-sectional view of the latch device 150, with the bolt 162 in an orientation in which it has been urged via the spring 164 to project into the cavity 180 of the striker plate 172. In this orientation, the drop gate is not capable of being pivoted downwardly out of the upper closed position shown in FIG. 1 to the lower open position shown in FIG. 2.

As illustrated in FIG. 8, the bolt 162 may include an integral handle 184. Also, the bracket 166 may include a lower slot through which the handle extends downwardly to enable a human finger to have access to push the bolt inwardly so as to no longer project in the cavity 180.

Figure 9:
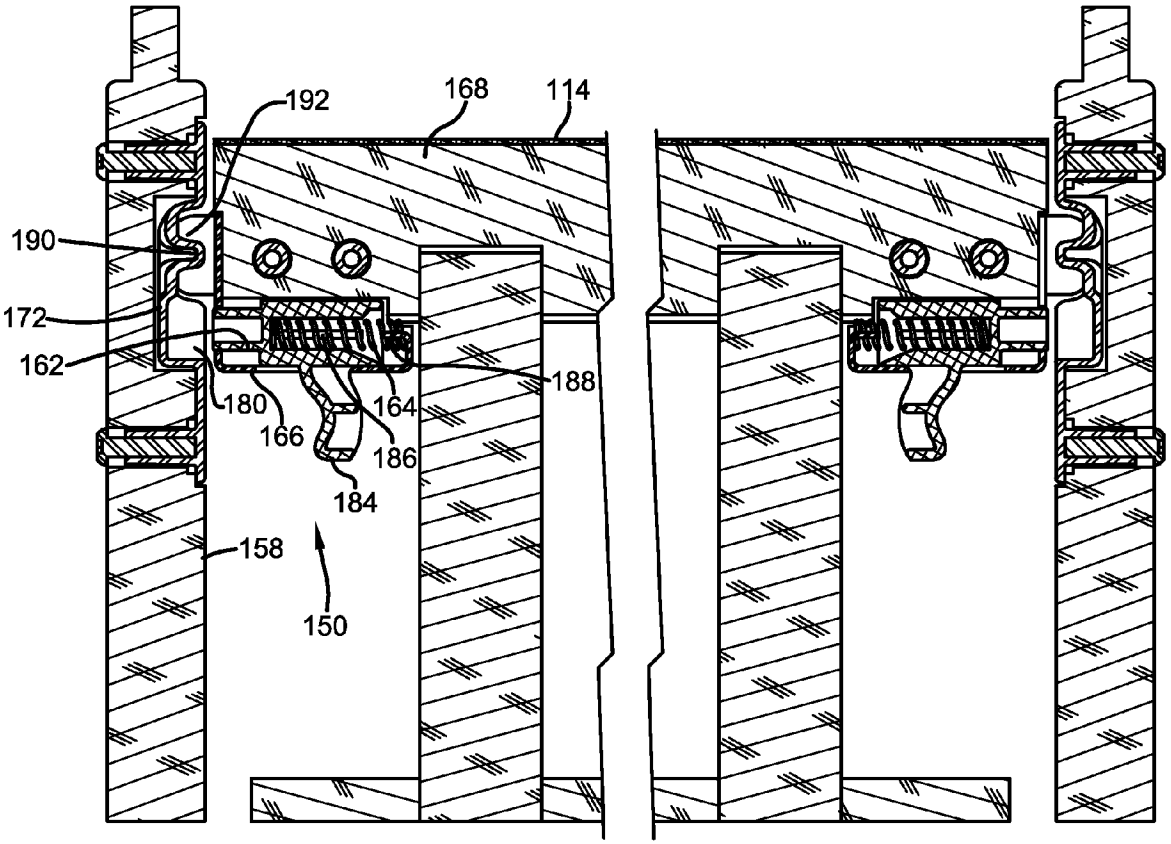

FIG. 9 shows an example of the latch device 150 in which the handle 184 of the bolt 162 has been moved inwardly (thereby further compressing the spring 164). In this orientation, the drop gate is capable of being pivoted downwardly to move to the lower closed position shown in FIG. 2. Also, as shown in FIGS. 9, the described bolt 162 may include a bore 186 therein which includes a portion of the spring 164 therein. In this example, the bracket 166 may include an inward hook 188 that is operative to extend through an end of the spring 164 that extends out of the bore 186 in the bolt 162.

Figure 10:
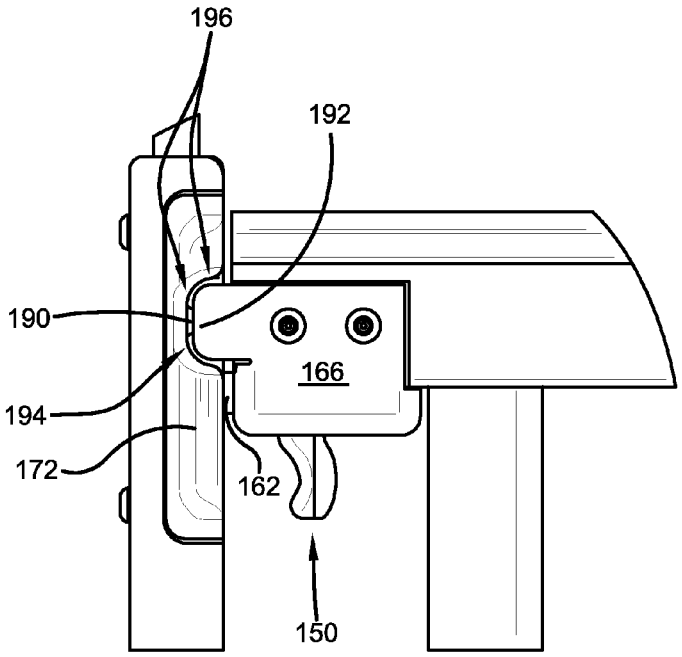
FIG. 10 shows a front plan view of an example embodiment of the latch device and the striker plate of the crib.

In order to stop the drop gate from pivoting into the interior space of the crib, the described striker plate 172 may include a projection 190 within the cavity 180 that is operative to contact a stop surface (e.g., a tab) 192 of the bracket 166 (when the drop gate is in the upper closed position). To further illustrate this arrangement, FIG. 10 shows a front side plan view of the described lock device 150, in which the tab 192 of the bracket 166 is in contact with the projection 190 of the striker plate 172. Also FIG. 10 shows the bolt 162 projecting into the cavity of the striker plate 172.

When the described crib is in use holding a child that is operative to stand up in the crib, it should be appreciated that such a child may be capable of placing his/her hands near the striker plate 172 (when the drop gate is in the lower open position). In order to minimize pinching of fingers in the latch device (when the drop gate is moved to the upper closed position), the described striker plate includes various beveled surfaces and spaces on and around the projection 190 which are operative to urge the child's fingers out of the path of portions of the latch device that could pinch the child's fingers.

For example, referring back to FIG. 7, the striker plate 172 may include a channel 194 adjacent the projection 190. As shown in FIG. 10, the tab 192 of the bracket may pass into and along the channel 194 in order to contact the projection 190. Also, as shown more clearly in FIG. 7, the channel may include beveled edges 196 (at the transition between inner surfaces of the channel 194 and the previously described beveled surface 182). As shown in FIG. 10, these beveled edges 196 bounding the inner surfaces of channel 194 have a generally C-shaped configuration which extends partially around the tab 192. However, as shown in FIG. 7, it should be appreciated that the beveled edges 196 of the channel 194 follow the slope of the beveled surface 182 and extend to the cavity 180.

If a child places his/her fingers adjacent these beveled surfaces, the child's fingers may still be contacted by the tab 192 (when the drop gate is closed). However, the injury to the child may be significantly minimized as a result of the edges 196 along the cavity 194 being beveled rather than squared off and sharp.

As shown in FIG. 8, in an example embodiment, the portion of projection 190 (that is contacted by the tab 192), has a size that is smaller than the facing surface area of the tab 192. In this described configuration of the striker plate, the cavity 180 includes ramp portions 206, 208 that extend in spaces of the cavity on either side of (above and below) the projection 190. These ramp portions 206, 208 extend adjacent the tab 192 (when the drop gate is in the closed position) and are angled (at an acute angle relative to the tab 192) such that when the drop gate closes, the tab 192 urges a finger (located above or below the projection 190) to move into the spaces of the cavity along the ramp portions and/or to slide up the ramp portions 206, 208 (thereby preventing pinching).

Also, as shown in FIG. 7, a front portion 198 of the projection 190 (that is contacted by the tab 192) is beveled (e.g., rounded). Thus, if a child places his/her fingers adjacent the projection 190 and/or the channel 194, (when the drop gate is moved to the closed position) the relatively larger tab (compared to the front portion 198 of the projection 190) may be operative to push such fingers into one of the spaces of the cavity adjacent the ramp portions 206, 208 of the cavity 180 on either side of (e.g., above or below) the projection 190, rather than pinching the fingers between the tab and the front portion 198 of the projection 190.

As shown in FIG. 7, in example embodiments, the cavity 180 may also be sufficiently wide to receive fingers in a rearward space 200 of the cavity 180 adjacent the bolt, when the bolt extends into the cavity. When the drop gate is in the closed position and the tab 192 contacts the projection 190 to stop the drop gate from moving, the bolt is positioned to project into a forward space 202 of the cavity 180, thereby pushing any fingers into the rearward space 200 (rather than pinching them). In an alternative embodiment, such a rearward space 200 may include a ramp portion as well (at an acute angle with respect to the longitudinal axis of the bolt) so as to urge fingers out of the cavity when the bolt projects into the cavity 180.

Also, it should be appreciated that alternative embodiments may include other arrangements and configurations for the latch device 150 and striker plate 172. For example, in an alternative embodiment, rather than having the bolt 162 and/or handle 184 be positioned generally below the hand rail 168, such an alternative embodiment may include a bolt and handle that is positioned within, beside or above the hand rail 168. Also in further alterative embodiments the orientation of the latch device 150 may be reversed with a bolt positioned to extend out of the vertical members (e.g. posts) and the striker plate mounted on the ends of the drop gate.

Figure 11:
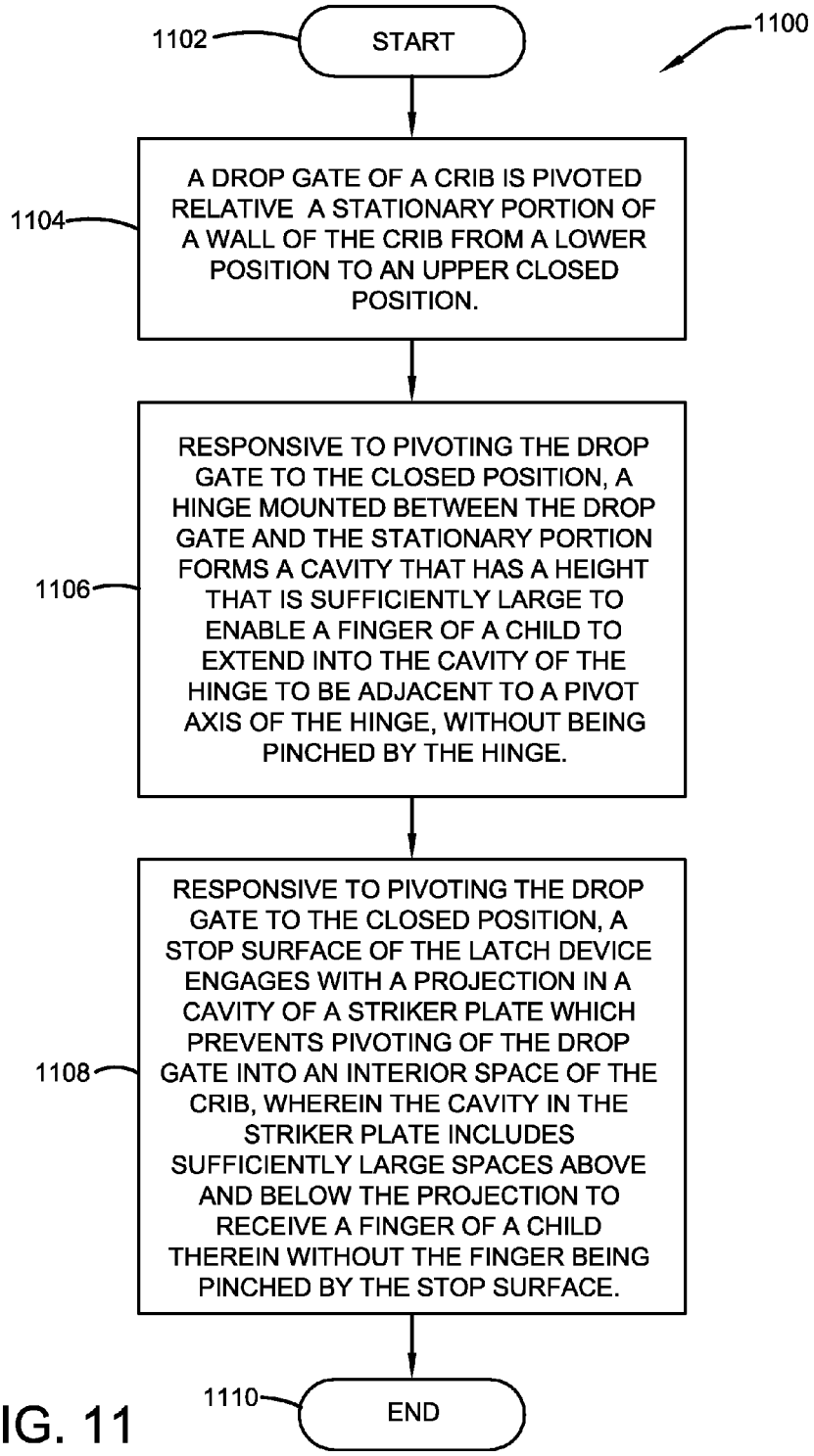
FIG. 11 shows a flow diagram that illustrates an example methodology for operating the crib.

With reference now to FIG. 11, an example methodology is illustrated and described associated with the operation of one or more of the previously described examples of the crib. While the methodology is described as being a series of acts that are performed in a sequence, it is to be understood that the methodologies are not limited by the order of the sequence. For instance, some acts may occur in a different order than what is described herein. In addition, an act may occur concurrently with another act. Furthermore, in some instances, not all acts may be required to implement a methodology described herein.

As illustrated in FIG. 11, the methodology 1100 begins at 1102, and at 1104 includes a step of pivoting a drop gate of a crib relative a stationary portion of a wall of a crib from a lower open position to an upper closed position. Responsive to pivoting the drop gate to the closed upper position, the methodology may include a step 1106 of forming with a hinge mounted between the drop gate and the stationary portion, a cavity therein. As discussed previously, the hinge includes a pivot axis. When the drop gate is in the closed position, the cavity of the hinge has a height that is sufficiently large to enable a finger of a child to extend into the cavity of the hinge to be adjacent the pivot axis, without being pinched by the hinge.

In addition responsive to pivoting of the drop gate to the closed upper position, the methodology may include a step 1108 of engaging a stop surface of a latch device with a projection in a cavity of a striker plate which prevents pivoting of the drop gate into an interior space of the crib. In this step the cavity in the striker plate includes sufficiently large spaces above and below the projection to receive a finger of a child therein without the finger being pinched by the stop surface.

At 1110 the methodology ends. However, it should be appreciated that the described methodology may include further or alternative steps. For example the methodology may include a step of engaging the bolt of the latch device in the cavity of the striker plate such that there is sufficient space in the cavity for a finger to extend therein without being pinched by the bolt. Also in this example embodiment, the projection in the cavity and the stop surface may be positioned to stop further movement of the bolt from pinching the finger.

In addition, when a finger is actually placed adjacent the hinge during the pivoting step, the methodology may include a step that is responsive to the pivoting step to have portions of the drop gate and/or hinge contact the finger and urge the finger into the cavity of the hinge generated in the forming step. Also, when a finger is actually placed adjacent the striker plate during the pivoting step, the methodology may include a step that is responsive to the pivoting to have portions of the drop gate and/or latch device contact the finger and urge the finger into spaces in the cavity of the striker plate above or below the projection and/or adjacent the bolt. Also, the methodology may include a step that is responsive to the pivoting step to have portions of the drop gate and/or latch device contact the fingers and urge the fingers of a user along the previously described beveled surfaces and ramps of the striker plate and out of locations that may cause the fingers to be pinched.

Cribs are often used at day care centers to hold children. At such facilities, the cribs may also be used to transport children out of the day care building during, for example, an evacuation from a fire, earthquake, or other hazardous condition in the building or for any other purpose. To get the children out of the building as quickly as possible, two or more children may be placed in the crib and the crib is then moved out of the building. However, many cribs are generally design to support one child. Also, to exit a building, a crib may need to roll over bumps on the floor and/or strike other objects as it is moved, which could cause the crib (such as a leg of the crib) to break.

Figure 12:
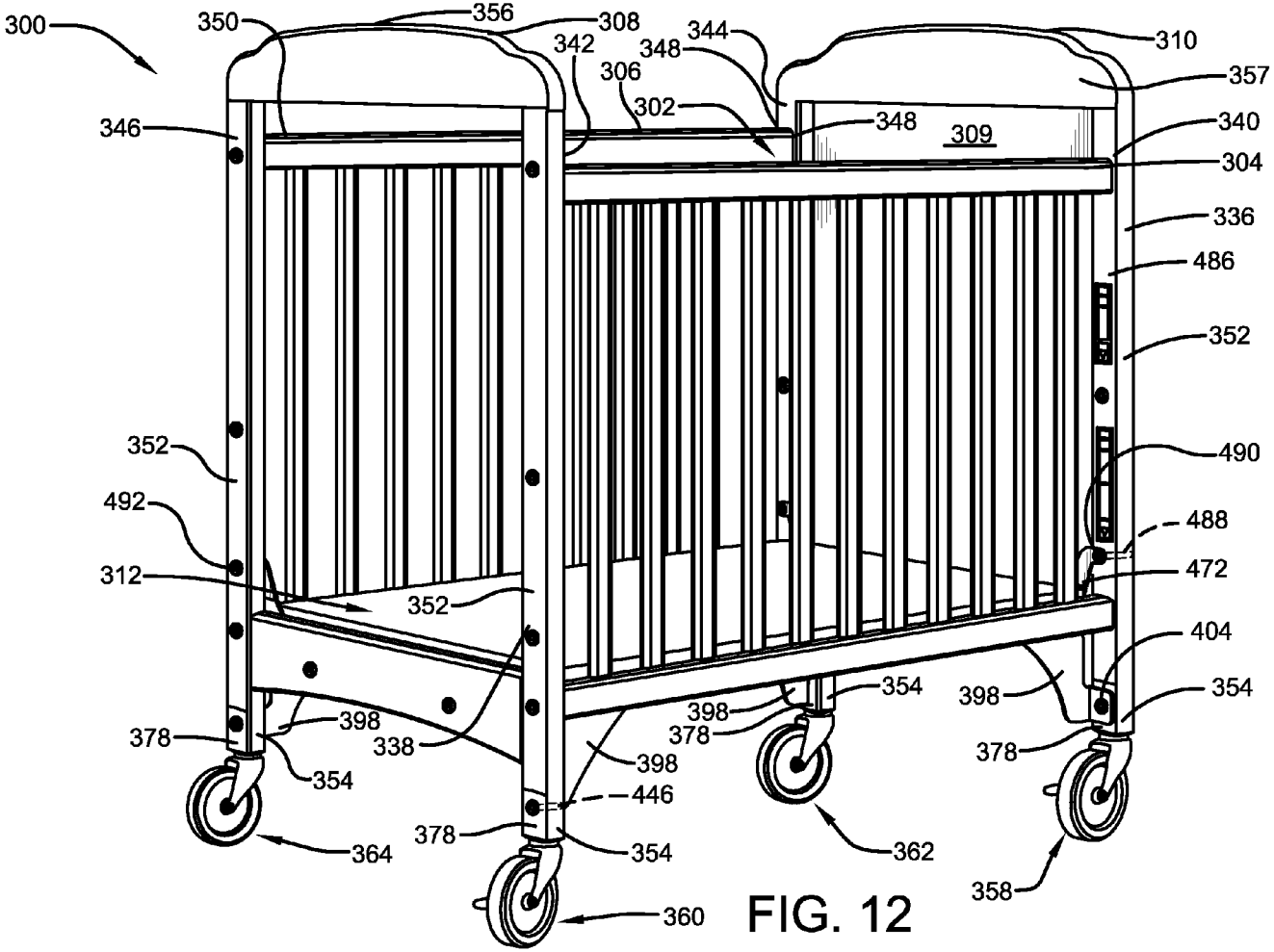
FIG. 12 shows a front and left perspective view of another example embodiment of a crib.

FIG. 12 shows an exemplary embodiment of a crib 300 that is configured to provide additional support in cases of an emergency evacuation, where one or more children are placed in the crib. The crib 300 includes an interior space 302 that is bounded by front and rear walls 304, 306, and left and right side walls 308, 310. The walls 304, 306, 308, 310 of the crib 300 may be comprised of vertical slats, rails, posts, boards, and any other elements operative to form a barrier that keeps a child within the interior space. Walls 308, 310 may also comprise a transparent thermoplastic portion 309 such as plexiglass® or other transparent material. Alternatively, the walls may include a mirror or reflective material provided on their inner surface. A bottom portion 312 of the interior of the crib 300 may include slats, a board, frame, and/or other types of support members that are capable of supporting a mattress. These described elements of the crib 300 may be made out of materials such as wood, plastic, metal, and combinations thereof. Also one or more of these described elements of the crib may be integrally formed and/or may be fastened together via fasteners (e.g., screws, bolts, clips, adhesives).

Figure 13:
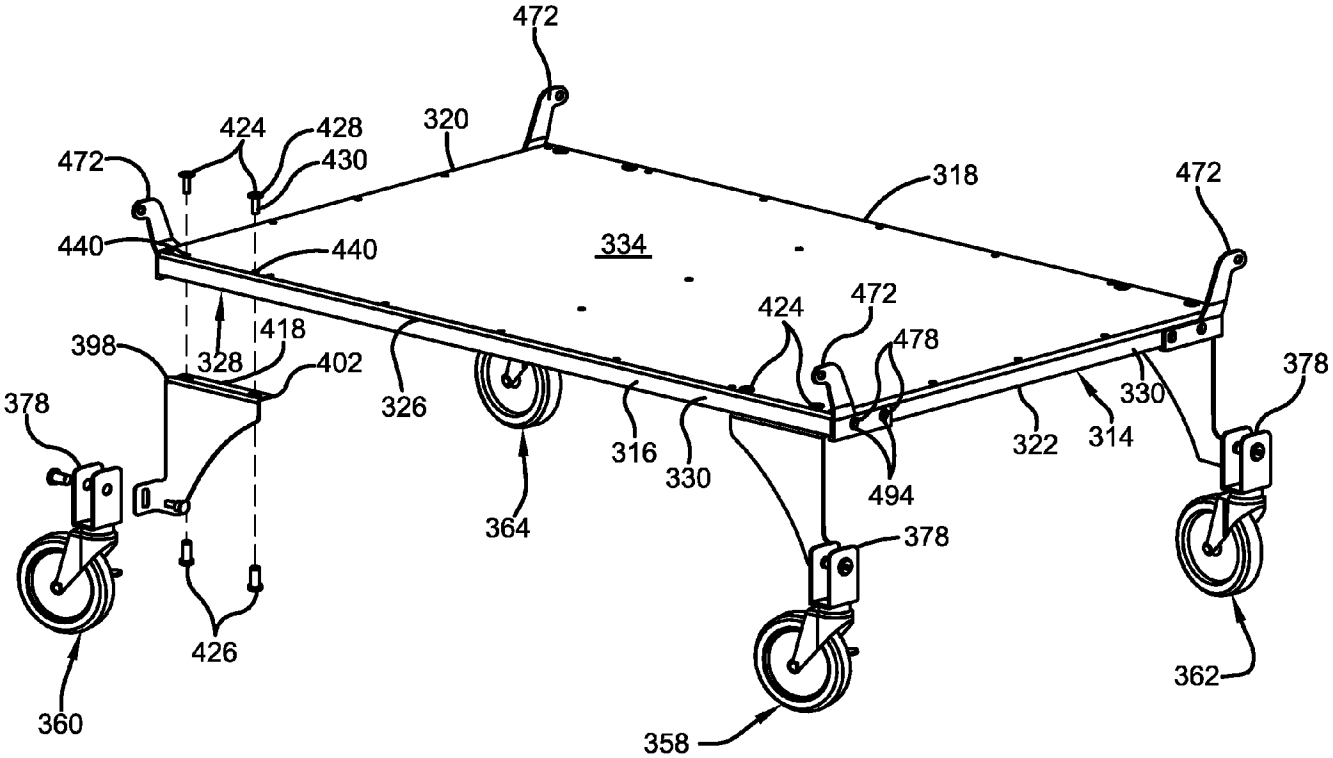
FIG. 13 shows a front and right perspective view of a bottom portion of the crib of FIG. 12 and related elements with a portion of the crib in exploded view.
Figure 14:
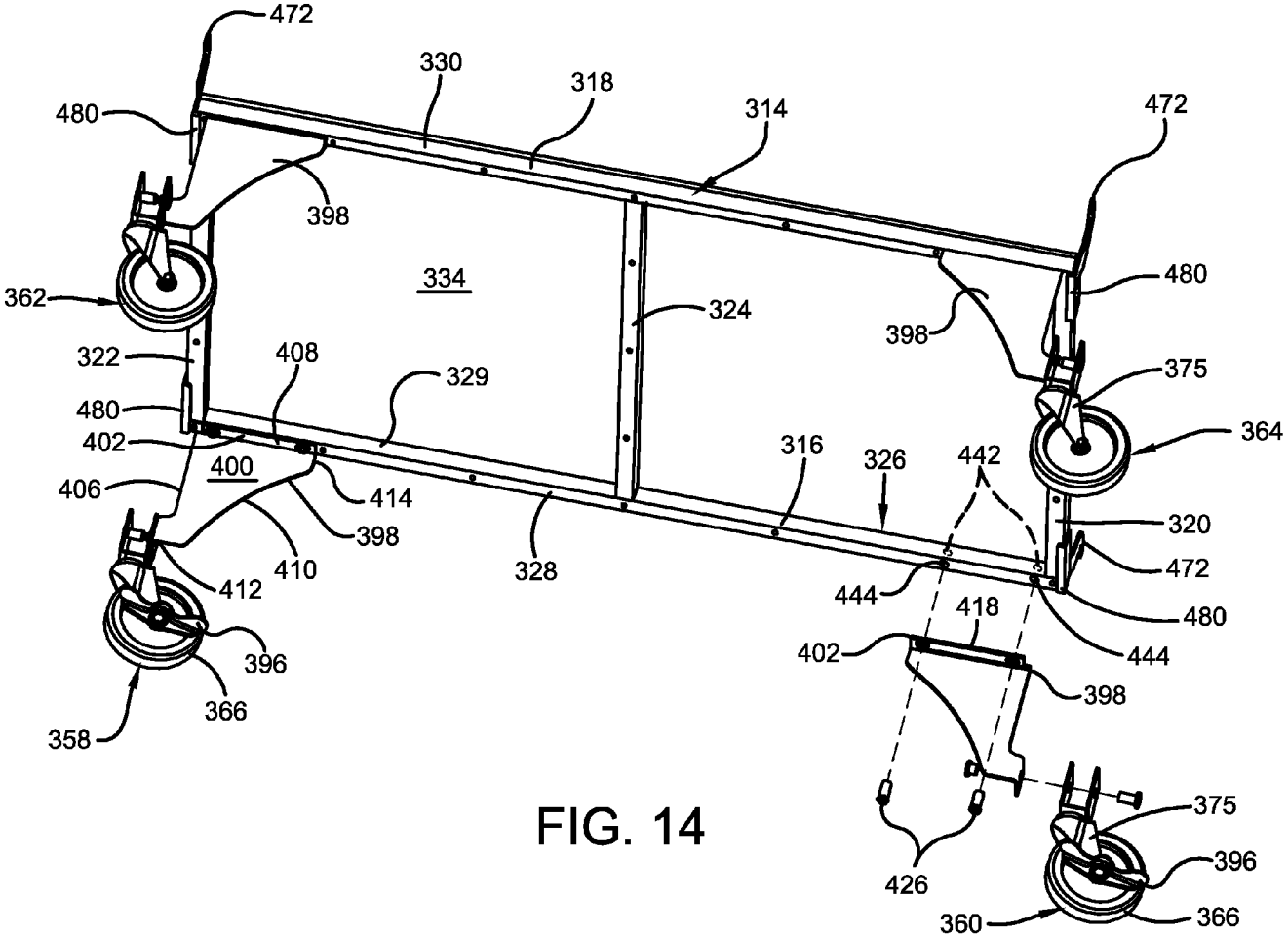
FIG. 14 shows a bottom and rear perspective view of the portion of the crib of FIG. 13.
Figure 15:
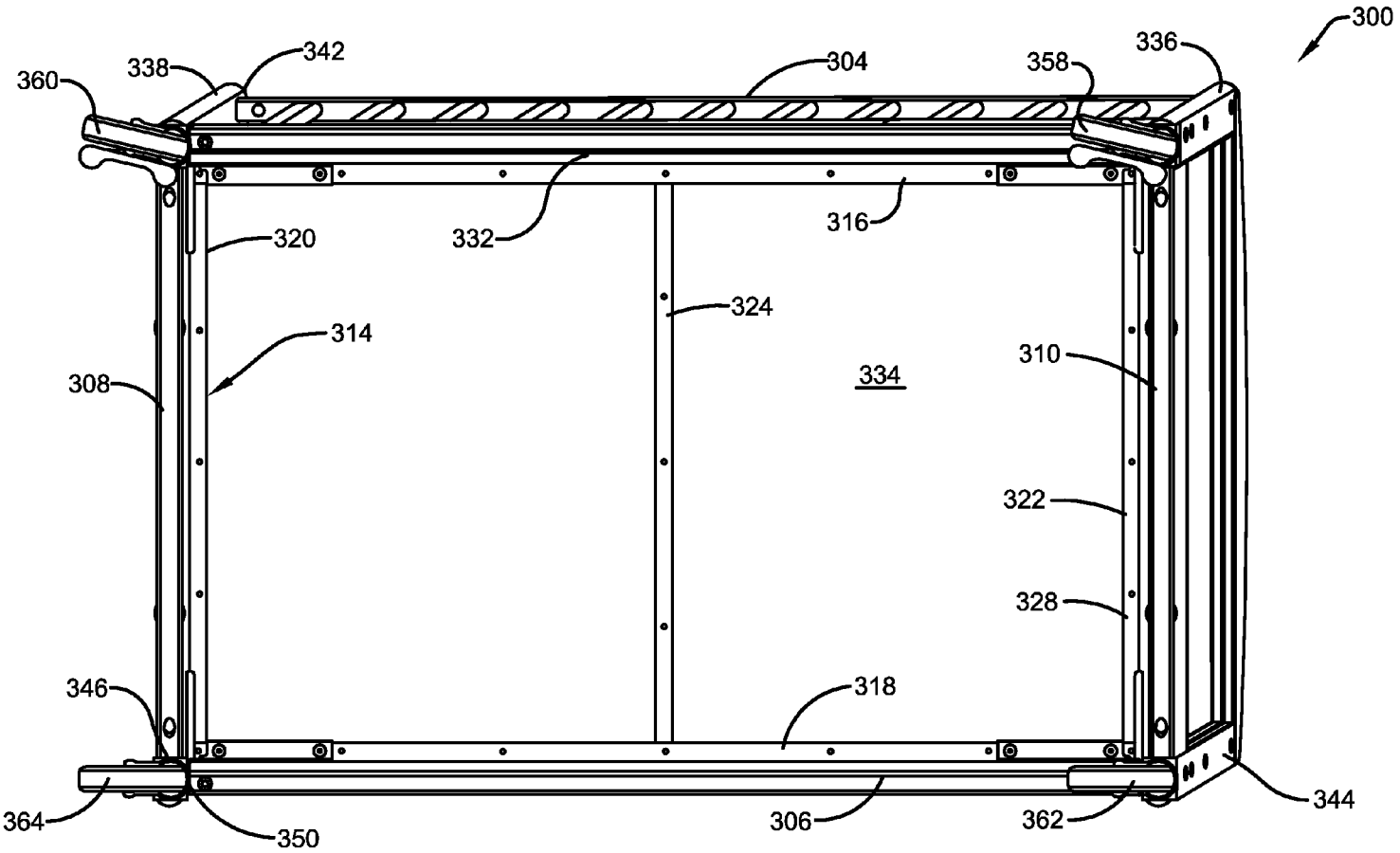
FIG. 15 shows a bottom perspective view of the crib of FIG. 12.

For example, in an example embodiment, the bottom portion 312 may include a rectangular frame 314 as depicted in FIGS. 13-15. The frame 314 may be made of metal such as steel or any other suitable high strength material. The frame 314 may include front and rear side rails 316, 318, and left, right and intermediate cross members 320, 322, 324 that extend between the front and rear side rails 316, 318. The cross members may be attached to the side rails by fasteners or other suitable ways such as welding. The number of cross members may vary depending upon the particular crib, and its size or desirability. For example, there may be no intermediate cross member between the right and left cross members if the crib size is very small or more than one intermediate cross member between the right and left cross members to provide additional support to the mattress if the crib size is large.

Each of the front and rear side rails 316, 318 and cross members 320, 322, 324 may be tubular and square shaped in cross section and may include top, bottom, inner, and outer walls 326, 328, 329, 330. In this example, each of the side rails and cross members are generally formed in one piece and generally constructed of iron, steel, or other suitable rigid material. However, it should be appreciated that in other examples the side rails and cross member may have other shapes and configurations operative to support a mattress and more than one child.

As show in FIG. 15, the frame 314 may be spaced inwardly from the walls 304, 306, 308, 310 at a sufficient distance that allows a finger of a child to extend through gap 332 between the walls 304, 306, 308, 310 and the frame 314 without being pinched. A board 334 may be positioned upon the top wall 326 of the frame 314 and may extend to the peripheral end of the frame 314 to provided additional support to the mattress as shown in FIG. 13. The board 334 may be made out of wood, particle board, or other materials. Alternatively or in addition, a wired spring mesh may be attached to the frame 314 and extend between the front and rear side rails and left and right cross members to provide additional support to the mattress.

As shown in FIG. 12, two elongated vertical members 336, 338 may bound the opposed side ends 340, 342 of the front wall 304 and two elongated vertical members 344, 346 may bound the opposed side ends 348, 350 of the rear wall 306. The vertical members 336, 344 may also correspond to posts and/or side ends of the right side wall 310, and the vertical members 338, 346 may correspond to posts and/or side ends of the left side wall of 308 of the crib. The vertical members may be made of wood or other suitable material. Each of the vertical members 336, 338, 344, 346 includes an upper end 352 that extends above the bottom portion 312 (e.g., where the board 334 is located) and a lower end 354 (see vertical member 336 of FIG. 12) that extends below the bottom portion 312. A left headboard 356 of the left side wall 308 may be positioned upon the upper ends 352 of the vertical members 338, 346. A right headboard 357 of the right side wall 310 may be positioned upon the upper ends 352 of the vertical members 336, 344. Casters 358, 360, 362, 364 may be operatively connected to the lower ends 352 of their respective vertical members 336, 338, 344, 346 so as to be in contact with the floor.

Figure 16:
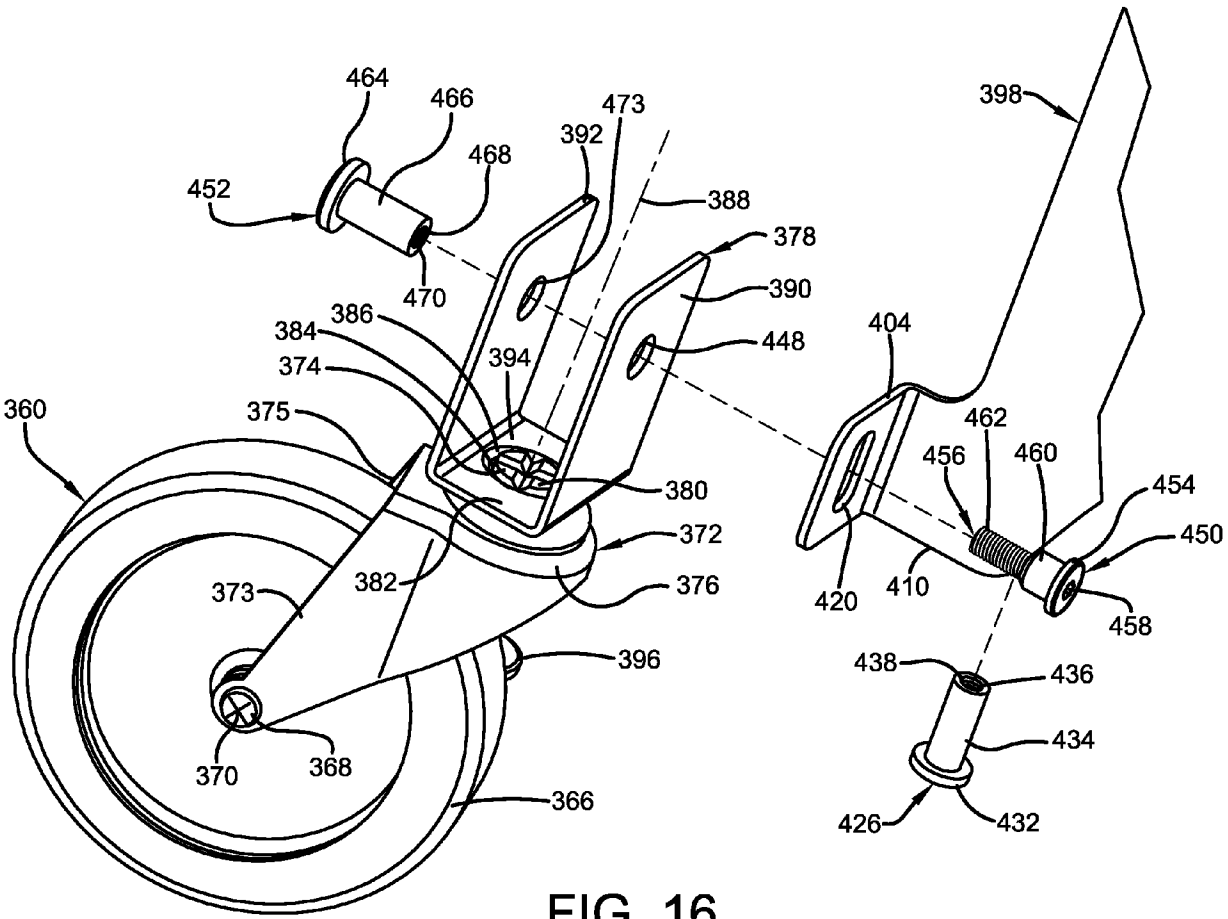
FIG. 16 shows an exploded view of the caster of the crib of FIG. 12 and related elements.

Referring to FIG. 16, each caster includes a roller 366 that is cylindrical and includes an axle 368 that rotates about an axis 370 that is parallel to the floor. The caster may also include a housing 372 defining a fork. The fork 372 may include two legs 373, 375 that are rotatably connected to opposite ends of the axle 368 in a manner that allows rotation of roller 366 about the axis 370 relative to the housing 372. The housing 372 may also include an upstanding stem 374 that is fixed to a junction portion 376 of the legs 373, 375 at the upper end of the housing 372.

The stem 374 may be rotatably connected to a holder 378, which in this example is U-shaped. The holder is operative to receive and mount to the lower end of a respective vertical member (e.g. a foot) of the crib. In particular, the stem 374 includes a shaft (not shown) and a head 380 that is sized larger than the shaft. The holder 378 includes a base 382 that has an opening 384 that receives the stem 374. The opening 384 may be bounded by a beveled peripheral edge 386 that slopes downwardly and radially inwardly. The head 380 is slidably seated upon the top surface of the peripheral edge 386 such that the head may rotate relative to the holder 378 about an axis 388 of the stem 374. Thus, since the housing is fixed to the stem 374, the housing 372 and the roller 366 swivel about the axis 388 of the upstanding stem 374 such that the roller 366 becomes aligned with the proper path of travel when the crib 300 is being moved. Each of the holders 378 further includes opposite upstanding inner and outer flanges 390, 392 that extend upwardly from the base 382 and receive the lower end 354 of their respective vertical members 336, 338, 344, 346 as shown in FIG. 12. Specifically, the lower end 354 of the vertical member associated with the caster extends between the inner and outer flanges 390, 392 and abuts top surface 394 of the base 382. As shown in FIG. 16, the head 380 of the stem 374 is positioned below the top surface 394 of the base 382 and thus is spaced from the lower end 354 of the associated vertical member to prevent the vertical member from interfering with the rotation of the stem 374 and hence swivel of the roller 366 about axis 388.

The holder 378 may be made of a rigid metal and formed in one piece or multiple pieces by any suitable method such as by a stamping or die casting process. Alternatively, the holder 378 may be formed by several pieces such as by welding the flanges 390, 392 to the base 382. Also, further examples of the holder 378 may have additional upstanding flanges or have upstanding flanges formed in one piece to define a tube that completely surrounds the inner end of the vertical member. For example, the holder may have four upstanding flanges that form four walls of a rectangular cavity, into which the lower end 354 (e.g. foot) of each vertical member extends.

In example embodiments, brakes 396 may be operatively connected to each roller 366 of casters 358, 360. As best shown in FIG. 14, the brakes are generally in the form of a large wing nut that is threadily connected to one end of the axle 368. Rotating the brake counterclockwise (as viewed in FIG. 14) engages the brake 396 to the roller 366 to prevent rotation of the roller 366 along the floor and rotating the brake 396 clockwise disengages the brake 396 to the roller 366 to allow rotation of the roller 366 along the floor.

Figure 17:
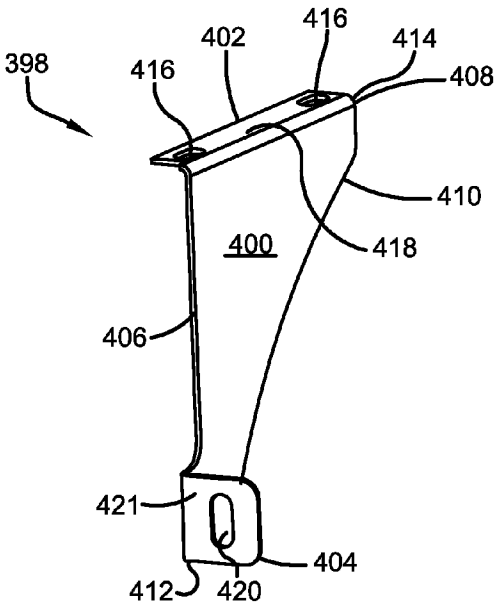
FIG. 17 shows a perspective view of a reinforcing member of the crib of FIG. 12.

As shown in FIG. 12, the crib 300 may include gussets 398 that provide additional support to frame 314 and vertical members 336, 338, 344, 346. As shown in FIG. 17, each of the gussets 398 may be formed in one piece of a suitable rigid material such as steel. The gusset 398 may include a base 400, and upper and lower flanges 402, 404.

As shown in FIG. 14, the base 400 may be generally triangular in shape and may include a vertical side end 406 and an upper end 408 that extends horizontally from the top of the vertical side end 406 when the gusset is installed on the crib. The gusset 398 may further include a third side 410 end that extends a small distance horizontally from a lower end 412 of the vertical side end 406 and then concavely curves upwardly and away from the vertical side end 406 and then extends upwardly to inner end 414 of the upper end. The upper flange 402 is generally horizontal and extends inwardly from the upper end 408.

As shown in FIG. 17, the upper flange 402 includes two mounting apertures 416. The lower flange 404 is generally vertical and extends outwardly from the vertical side end 406 when the gusset 398 is mounted to the crib. The lower flange 404 includes a mounting aperture 420 and outer side 421. In other examples, the gussets 398 may have other shapes and configurations. For example, third side 410 may be straight or convex, rather than concave.

Each of the gussets 398 may be mounted to its respective vertical member, holder, and side rail of the frame as follows. As depicted in FIG. 13, the top surface 418 of the upper flange 402 of the gusset 398 is positioned flushed (as shown in FIG. 14) on the underside of the bottom wall 328 of the associated side rail. A fastening arrangement such as bolts 424 and T-nuts 426 may be used to fasten the gusset 398 to the frame 314 and board 334. Each bolt 424 may include a head 428 and a threaded shaft 430. The head 428 has a diameter that is larger than its corresponding hole 440 in the board and includes a recess configured to receive an Allen wrench. As depicted in FIG. 16, each of the T-nuts 426 includes a head 432 and a hollow shaft 434. The shaft 434 includes a longitudinal bore 436. Threads 438 are provided on the interior surface of the shaft defining the bore 436. The head 432 has a diameter that is larger than the mounting aperture 416 of the upper flange 402 and includes a recess configured to receive an Allen wrench. The bolts 424 are inserted into holes 440 in the particle board and apertures 442 (FIG. 14) in the top wall 326 of the associated side rail. The T-nuts 426 are then inserted into their respective apertures 416 of the upper flange 402 and respective apertures 444 in the bottom wall 328 of the associated side rail until the interior threads 438 of the shafts of the T-nuts 426 engages the corresponding threaded shafts 430 of the bolts 424. The bolts 424 and/or T-nuts 426 are turned clockwise until the heads 432 of the T-nuts bear against the upper flange 402 and the heads 428 of the bolts 424 bear against the top of the particle board 334.

As depicted in FIGS. 12, 16 and 17, the outer side 421 (FIG. 17) of the lower flange 404 of the gusset 398 is positioned flushed on the inner flange 390 (FIG. 16) of the holder 378 such that the aperture 420 of the lower flange 404 of the gusset 398 is aligned with an aperture 448 of the inner flange 390 and a lateral bore 446 (FIG. 12) formed in the lower end 354 of the associated vertical member. The aperture 420 of the lower flange 404 of the gusset 398 has a greater height than the aperture 448 of the inner flange 390 of the holder 378 to accommodate possible various mounting locations of the inner flange 390 and lower flange 404 due to tolerances associated with the manufacturing parts and assemblies.

A fastening arrangement is used to fasten the gusset, holder, and vertical member together. As depicted in FIG. 16, the fastening arrangement may include a threaded fastener such as a wood screw or threaded bolt 450 and a T-nut 452. The threaded bolt 450 includes a head 454 and a shaft 456. The head 454 has a diameter that is larger than the width of the aperture 420 and includes a recess 458 configured to receive an Allen wrench. The shaft 456 comprises an unthreaded portion 460 adjacent the head 454 and threaded portion 462 adjacent the unthreaded portion 460. The T-nut 452 includes a head 464 and a hollow shaft 466. The shaft 466 includes a longitudinal bore 468. Threads 470 are provided on the interior surface of the shaft that define the bore 468. The head 464 has a diameter that is larger than the width of mounting aperture 473 of the outer flange 392 of the holder 378 and also includes a recess configured to receive an Allen wrench. The T-nut 452 is inserted into the aperture 473 and bore 446 of the lower end 354 of the associated vertical member. When inserted, the shaft 466 of the T-nut 452 extends partially through the bore 446 of the vertical member. The threaded bolt 450 is then inserted into the apertures 420 and bore 446 until the threaded portion 462 of the shaft 456 extends into the threaded bore 468 of the shaft 466 of the T-nut 452. In particular, the threads 470 on the interior surface of the shaft threadily engage the corresponding threaded portion 462 of shaft 456 of the threaded bolt 450. The threaded bolt 450 and/or T-nut 452 is turned clockwise until the head 464 of the T-nut 452 bears against the outer flange 392 and the head 454 of the threaded bolt 450 bears against the lower flange 404 of the gusset 398. The unthreaded portion 460 of the shaft 456 of the threaded bolt 450 is designed to slide through the vertical member so that the threaded bolt 450 can be pulled tight to the lower flange 404 to tightly fasten the gusset 398, holder 378, and vertical member to each other. Alternatively, other suitable types of fastening arrangements may be used to mount each reinforcing member (e.g. gusset) to the holder associated with a caster and the lower portion (e.g. foot) of the vertical members (e.g. posts) of the crib, as well as the frame that supports the mattress.

In an example embodiment, the crib may further include upper reinforcing members 472 (FIG. 14) that are mounted between respective left and right cross members 320, 322 and corresponding vertical members 336, 338, 344, 346 (FIG. 12). The reinforcing member 472 may attach the frame or mattress support to the vertical members of the crib and provides additional support. The reinforcing member 472 may be a spring bracket or any other suitable member for attaching the mattress support to the crib.

Figure 18:
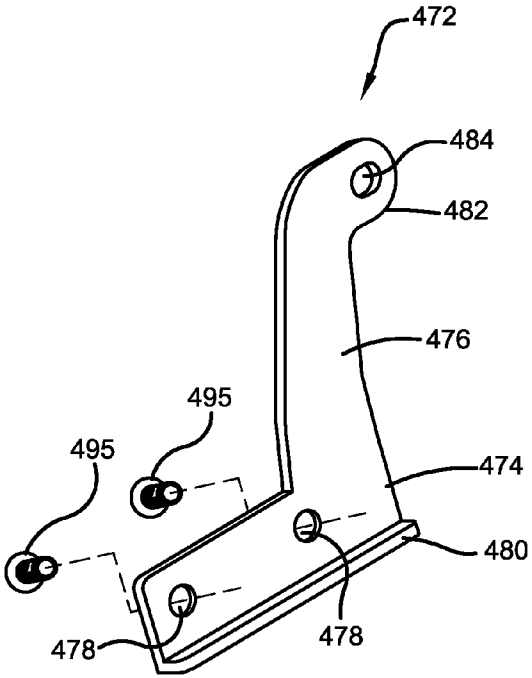
FIG. 18 shows an exploded perspective view of the reinforcing member and its fastener for the crib of FIG. 12.

As shown in FIG. 18, each upper reinforcing member 472 may be formed in one piece of a suitable rigid material such as steel. Each reinforcing member 472 may comprise a rectangular base 474 and a hook-shaped member 476. The base 474 may include a pair of apertures 478 and an inwardly extending support step 480 at its lower end. The hook-shaped member 476 extends upwardly from the base 474 and may slanted at an acute angle towards its respective vertical member (as best seen in FIG. 12), and then terminates into an upper mounting end portion 482. The mounting end portion 482 includes a mounting aperture 484.

To mount the reinforcing member 472 to its respective right or left cross member and vertical member, the mounting end portion 482 may be fastened (flush or spaced apart with washers) to the inwardly facing side 486 (FIG. 12) of the corresponding vertical member such that the aperture is aligned with a lateral bore 488 (FIG. 12) in the vertical member. A fastening arrangement such as a threaded bolt and T-nut type arrangement as previously mentioned may then be used to mount the mounting end portion 482 to the vertical member. In particular, as best depicted in FIG. 12, a wood screw or threaded bolt 490 may be inserted into the mounting aperture 484 and bore 488 such that it threadily engages a T-nut 492 inserted into the bore 488 on the opposite side of the vertical member.

As shown in FIG. 13, the base 474 is positioned on the outer wall 330 of the respective cross member such that the apertures 478 are aligned with holes 494 in the outer wall 330, and (as shown in FIG. 14) the support step 480 engages the underside of the bottom wall 328 of the respective cross member. Fasteners 495 (FIG. 18) such as threaded bolts are then threadily inserted into the apertures 478 and holes 494 to mount the base 474 to the cross member. Nuts may be turned on bolts to further secure the base 474 to the cross member.

It should be appreciated that the above described upper and lower reinforcing members and metal frame may provide addition strength to a crib in order to handle the weight of several children during an emergency evacuation. Further the reinforcing members may minimize the risk that the lower portions of the vertical members will break, when the crib is pushed over thresholds, steps and other non flat surfaces.

Also, it should be appreciated that when cribs are moved (during day to day use or emergency situations), cribs may hit structures or other objects which could damage the crib. To protect cribs, example embodiments may include bumpers that are placed on the exterior side of the walls of the crib. FIGS. 19-23 show an example embodiment of a crib 500 that comprises bumpers.

Figure 19:
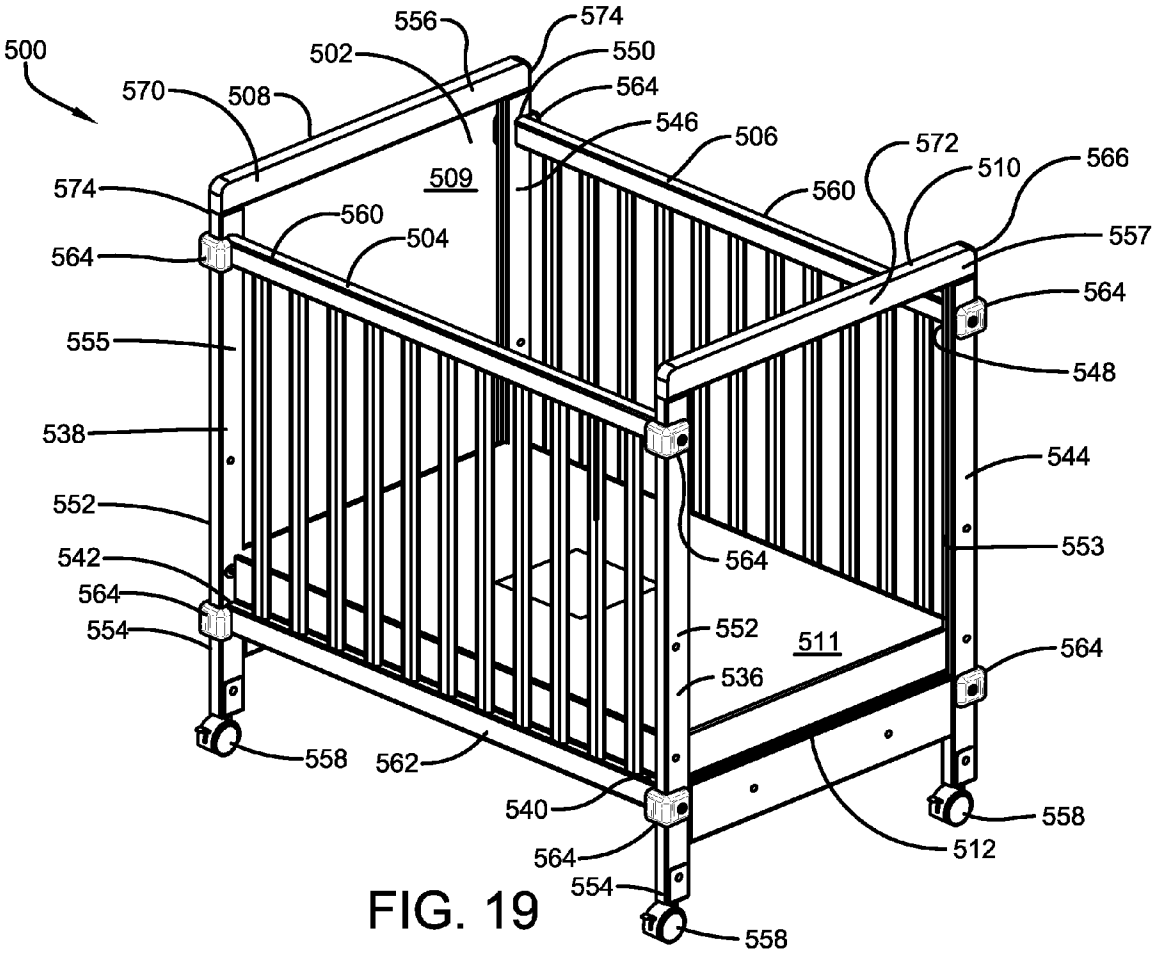
FIG. 19 shows a front and right perspective view of another exemple embodiment of a crib.
Figure 20:
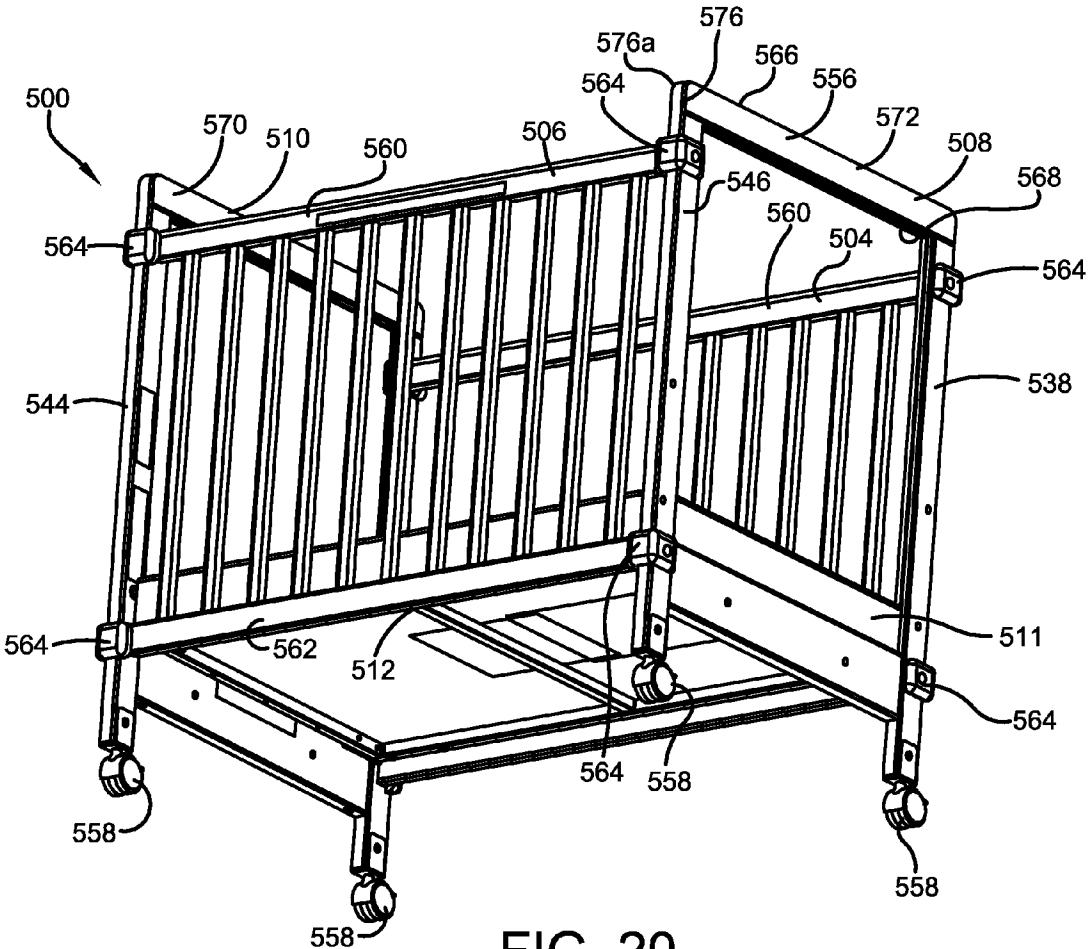
FIG. 20 shows a rear perspective view of the crib of FIG. 19.

Referring to FIGS. 19 and 20, the crib 500 includes an interior space 502 that is bounded by front and rear walls 504, 506, and left and right walls 508, 510. The walls 504, 506, 508, 510 of the crib 500 may be comprised of vertical slats, rails, posts, boards, and any other elements operative to form a barrier that keeps a child within the interior space. Walls 508, 510 may also comprise a transparent thermoplastic portion 509 such as plexiglass® or other transparent material. Alternatively, the walls may include a mirror or reflective material provided on their inner surface. A bottom portion 512 of the interior of the crib 500 may include slats, a board, frame, and/or other types of support members that are capable of supporting a mattress 511. These described elements of the crib 500 may be made out of materials such as wood, plastic, metal, and combinations thereof. Also one or more of these described elements of the crib may be integrally formed and/or may be fastened together via fasteners (e.g., screws, bolts, clips, adhesives).

Two elongated vertical members 536, 538 bound the opposed side ends 540, 542 of the front wall 504 and two elongated vertical members 544, 546 bound the opposed side ends 548, 550 of the rear wall 506. The vertical members 536, 544 may also correspond to posts and/or side ends of the right side wall 510, and the vertical members 538, 546 may correspond to posts and/or side ends of the left side wall of 508 of the crib 500. In this example, the vertical members have a generally rectangular cross section with generally flat sides, and may be made of wood or other suitable material. Also the edges of the vertical members may be beveled/rounded to reduce pointed edges. In addition, as discussed below with respect to FIG. 24, it should be appreciated that vertical members may have other cross-sectional shapes (such as one or more rounded sides). Each of the vertical members 536, 538, 544, 546 includes an upper end 552 and a lower end 554 (see vertical members 536, 538 of FIG. 19) and four flat side faces 549, 551, 553, 555 (FIG. 21) that are each rectangular in shape. Opposite side faces 551 and 553 are located at right angles to opposite side faces 549 and 555. Alternatively, opposite side faces 551 and 553 may be located at obtuse or acute angles with respect to opposite side faces 549, 555. The vertical members may also includes rounded or convexly curved side ends/edges 559, 561 (FIG. 21) at the intersections of adjacent side faces 551, 553 and side faces 549, 551, respectively, and convexly curved side ends/edges 563 at the intersection of adjacent side faces 549, 555 and at the intersection (not shown) of side faces 553, 555, respectively.

A left headboard 556 of the left side wall 508 may be positioned upon the upper ends 552 of the vertical members 538, 546. A right headboard 557 of the right side wall 510 may be positioned upon the upper ends 552 of the vertical members 536, 544. Each headboard may be generally rectangular in shape (or have other shapes) and comprises upper, lower, inner, outer, and side faces 566, 568, 570, 572, 574.

Figure 22:
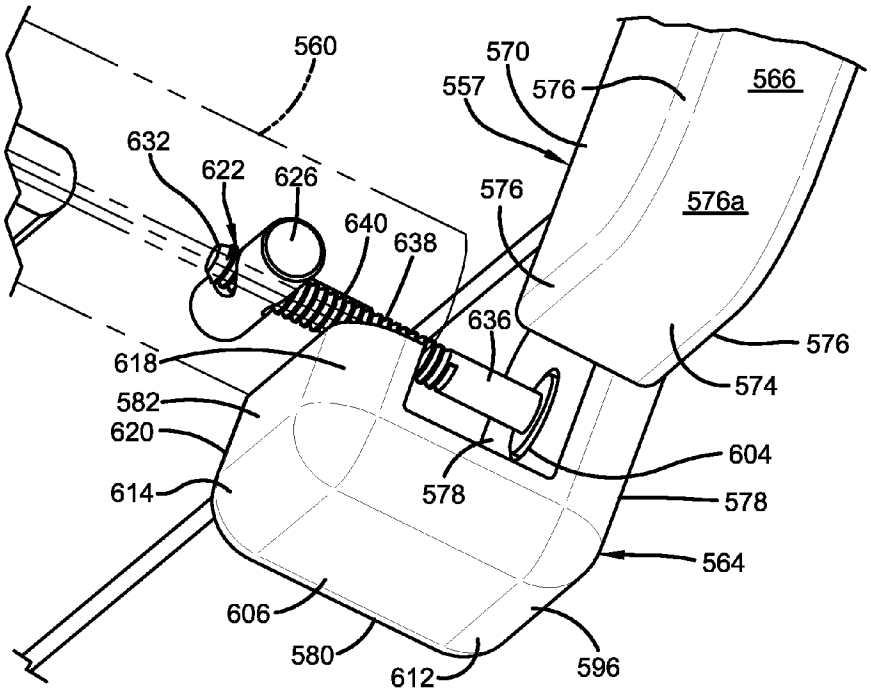
FIG. 22 shows a top perspective view of a portion of the crib of FIG. 19 with portions removed and in phantom to illustrate a bumper and its fastening arrangement.

As shown in FIGS. 20 and 22. The headboard may include rounded or convexly curved ends/edges 576 at the intersection of adjacent faces 566, 568, 570, 572, 574. That is the exterior surface of each of the ends 576 is convexly curved between the adjacent faces. At the intersection of the upper face 566 and a side face 574, the end or corner **576*a* has a lengthier curve than the other ends. As shown in FIG. 19, casters 558 may be operatively connected to the lower ends 554 of their respective vertical members 536, 538, 544, 546** and are in contact with the floor.

Each of the front and rear walls 504, 506 include upper and lower horizontal members 560, 562. The horizontal members may correspond to rails. Each of the upper and lower horizontal members 560, 562 extend between the side ends of their respective walls. One or more bumpers 564 may be mounted to each of the vertical members 536, 538, 544, 546. For example, one bumper 564 may be secured to the junction of a respective vertical member and the upper horizontal member 560, and a second bumper may be secured to the junction of the respective vertical member and lower horizontal member 562. However, it should be appreciated that in other examples a crib may only have bumpers only at the lower horizontal member or only at the upper horizontal member (and/or other combinations and arrangements of bumpers).

Figure 21:
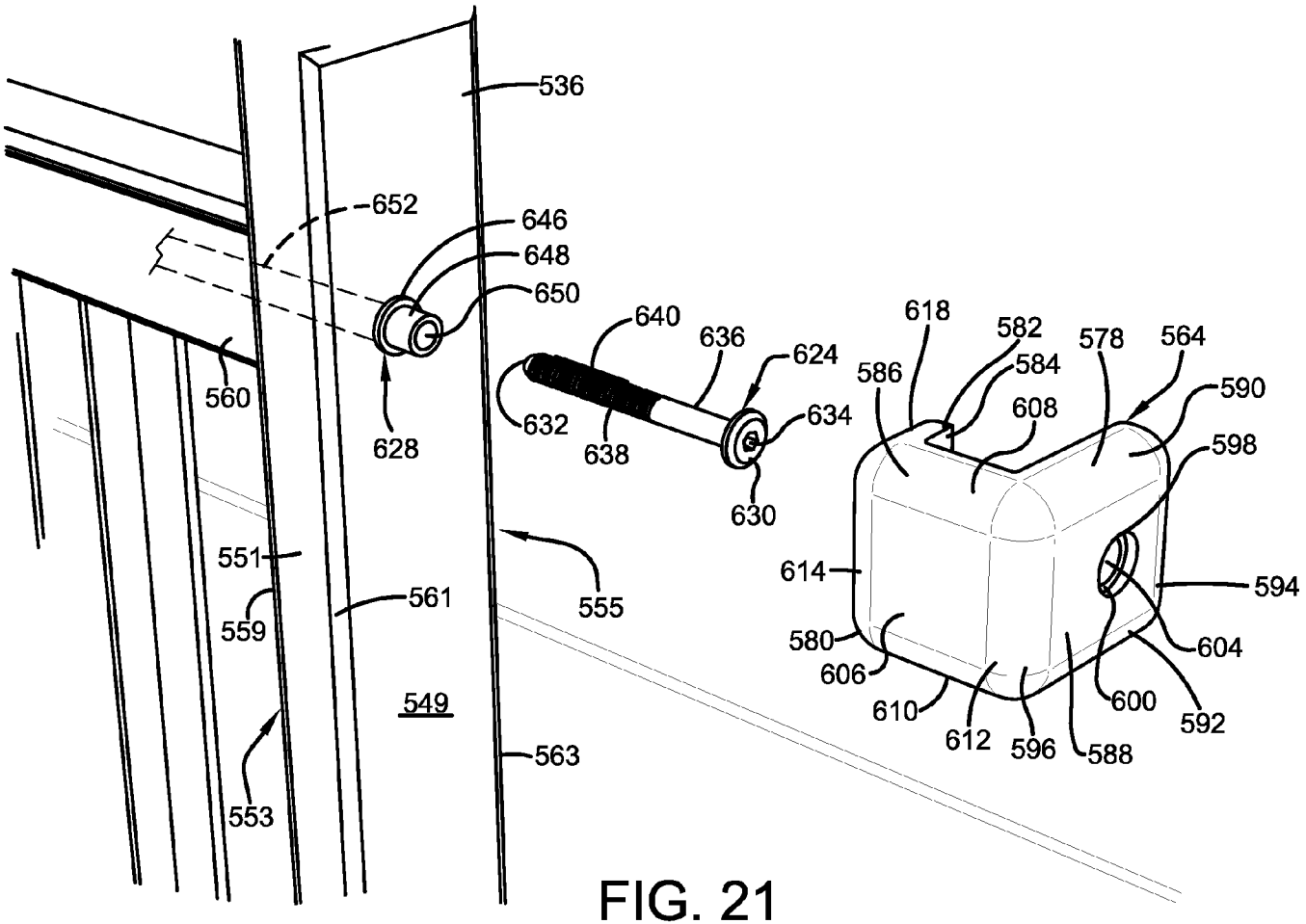
FIG. 21 shows a front perspective view of a portion of the crib of FIG. 19 and with a partial exploded view of a bumper and a portion of its fastening arrangement for the crib of FIG. 19.

Referring to FIG. 21, a bumper 564 may be generally L-shaped and may be made of a soft deformable and elastic material such as rubber or polyurethane. The bumper 564 may be formed in one piece by any suitable process such as injection molding. In this example, the bumper 564 may comprise first and second legs 578, 580 and a lip 582 that together define a hook like configuration. In this example, the bumper 564 also includes interior and exterior surfaces 584, 586.

Figure 23:
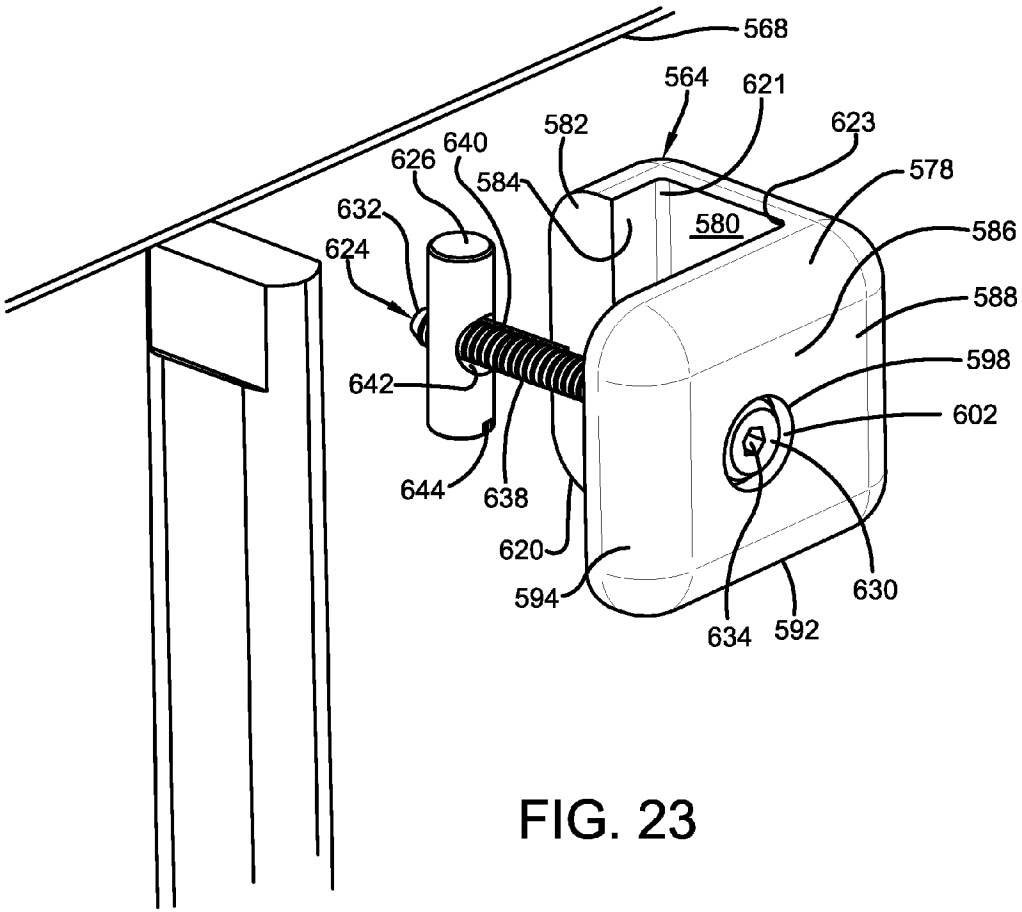
FIG. 23 shows a right perspective view of a portion of the crib of FIG. 19 illustrating the bumper located rearward to the bumper of FIG. 21.

The first leg 578 may have a generally flat square shaped base 588 with rounded upper, lower, and side ends 590, 592, 594, 596 at its periphery. In particular, the exterior surface 586 at each of the ends convexly curves radially outwardly from the base 588 as viewed in FIGS. 21-23. As shown in FIG. 23, the interior surface 584 of the first leg 578 may be flat. The first leg 578 may also includes a circular recess 598 formed in the exterior surface 586 at the center of the base 588. As shown in FIG. 21, the recess 598 is defined by a bottom face 600. As shown in FIG. 22, the recess 598 is also defined by a side wall 602. As shown in FIG. 21, the bottom face 600 of the recess 598 includes an aperture 604.

The second leg 580 may also have a generally flat square shaped base 606 with rounded upper, lower, and side ends 608, 610, 612, 614 at its periphery. In particular, the exterior surface 586 at each of the ends convexly curves radially outwardly from the base 606. The interior surface 584 of the second leg 580 may be flat. The second leg 580 may extend inwardly from side end 596 of the first leg 578 of the bumper 564 along the right or left direction (as viewed in FIG. 19). At the intersection of the first and second legs 578, 580, the curved side end 596 of the first leg 578 blends into the curved side end of the second leg 580 to define a curved junction portion of the two side ends. The lip 582 may extend inwardly from the side end 614 of the second leg along the front or rear direction (as viewed in FIG. 19). The lip 582 may include a rectangular shaped base with rounded upper and lower peripheral ends 618, 620. Specifically, the exterior surface 586 at each of the ends 618, 620 convexly may curve radially outwardly. The interior surface 584 of the base 616 may be flat.

As shown in FIG. 23, the bumper 564 may include concavely curved side ends 621, 623 formed in the interior surface 584 at the intersection of the first leg 578 and second leg 580 and at the intersection of the second leg 580 and lip 582. The side ends 621, 623 may be complimentary with the curved side ends 621, 623 of the vertical member and thus fittingly receive the respective side ends 559, 561 of the vertical member when the bumper 564 is mounted to the vertical member.

As shown in FIG. 22, the bumper 564 may be mounted to its respective vertical member by a fastening arrangement 622. The fastening arrangement 622 also secures the bumper 564, the respective vertical member, and the respective horizontal member to each other. Referring to FIGS. 21-23, the fastening arrangement 622 may include a fastener such as a bolt 624, a barrel nut 626 (FIGS. 22 and 23), and a bushing 628 (FIG. 21). The bolt 624 has a head 630 and a shaft 632. The head 630 includes a recess 634 configured to receive an Allen wrench. The shaft 632 includes an unthreaded portion 636 and a threaded portion 638. The threaded portion 638 also includes a flattened portion 640 extending axially a partial distance along the threaded portion 638.

As shown in FIG. 23, the barrel nut 626 includes a lateral hole 642 extending through its center. The barrel nut 626 also includes a slotted recess 644 formed in the exterior surface of an axial end of the barrel nut. The slotted recess 644 is configured to receive a blade of a suitable tool such as a slotted screwdriver.

As shown in FIG. 21, the bushing 628 includes a head 646 and a shaft 648 and an axial bore 650 extending through the head 646 and shaft 648. When the bumper 564, the vertical member, and the horizontal member are secured to each other, the shaft 632 of the bolt 624 extends through the aperture 604 of the bumper 564, the axial bore 650 of the bushing 628, and a horizontal bore 652 that extends through the vertical member and partially into the horizontal member. In this position also, the threaded portion 638 of the bolt 624 threadily engages the hole 642 of the barrel nut 626 to secure the bumper 564, the vertical member, and the horizontal member to each other.

To fasten the bumper 564, the vertical member, and the horizontal member to each other, the barrel nut 626 is positioned in the horizontal member such that the hole 642 (FIG. 23) is aligned with the horizontal bore 652 (FIG. 21). The bolt 624 is then inserted through the aperture 604 of the bumper 564 and the axial bore 650 of the bushing. The bumper 564 is then positioned on the vertical member such that the interior surface 584 at the first leg 578 contacts the side face 549 of the respective vertical member opposite or facing away from the horizontal member, and the interior surface 584 at the second leg 580 contacts the side face 551 of the vertical member opposite or facing away from the left or left walls 508, 510, the interior surface 584 at the lip 582 contacts a portion of the side face 555 of the vertical member facing the horizontal member.

The shaft 632 of the bolt 624 is then inserted into the bore 652 until it threadily engages the barrel nut 626. The bolt 624 is turned clockwise until the head 630 rests tightly upon the bottom face 600 of the recess 598 of the vertical leg (see FIG. 23) and the head 646 of the bushing is flushed with the interior surface 584 of the bumper 564 at the first leg 578 (see FIG. 22). When the bumper 564 is mounted to the vertical member, the shaft 648 of the bushing 628 bears against the underside of the bottom face 600 of the recess 598. Alternatively, the fastening arrangement may include just the threaded bolt. In either fastening arrangement, one single bolt 624 may only be needed to fasten the bumper, vertical member, and horizontal member to each other.

It should also be understood, that the curved configuration of the peripheral ends 590, 592, 594, 596 608, 610, 612, 614, 618, 620 of the bumper 564 may direct a child's finger or other body part that contacts the peripheral ends of the bumper 564 to gently slide off the bumper 564. This also reduces the possibility that the finger or other body part will be pinched between the interior surface 584 of the bumper 564 and vertical member. Also, as shown in FIGS. 19 to 21, the bases 588, 606 of the legs 578, 580 of the bumper 564 have a similar shape or configuration as the side faces of the vertical members and the faces 566, 568, 570, 572, 574 of each of the headboards 556, 557. Further, the curved side peripheral ends 594, 596, 612 of the legs 578, 580 have a similar contour as the curved side ends 559, 561 of the vertical member and the curved ends 576 of the headboard. This provides an aesthetically pleasing appearance.

Figure 24:
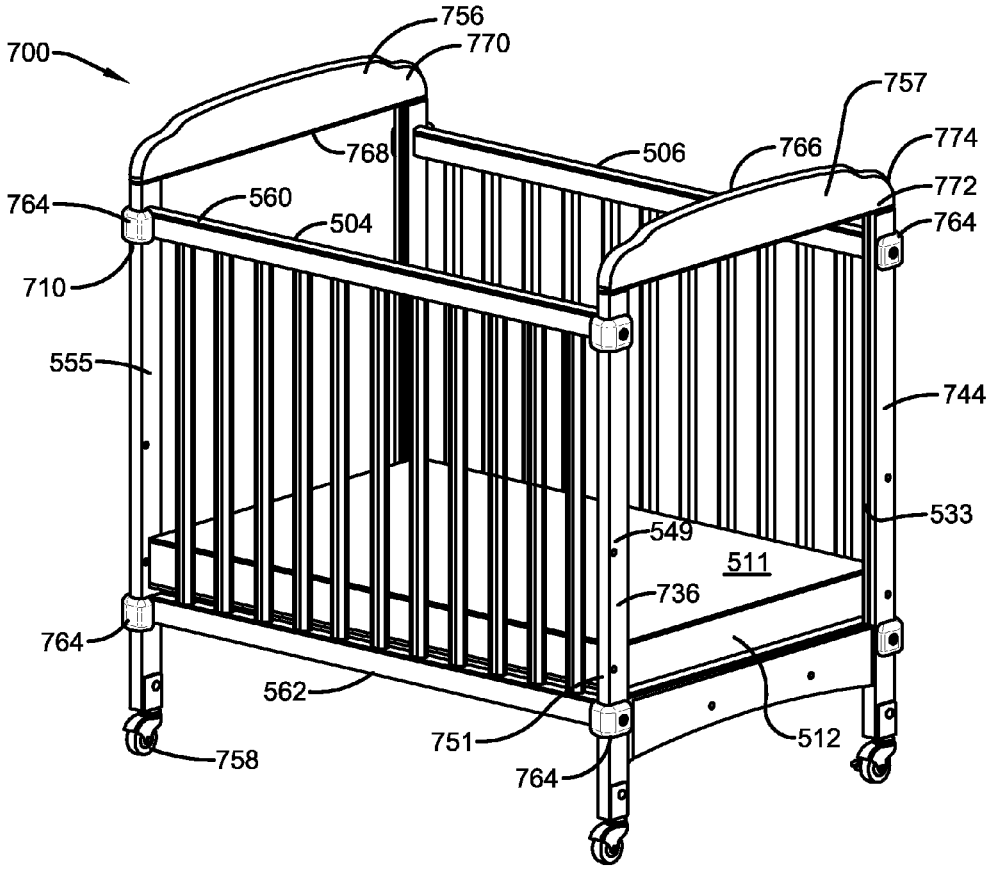
FIG. 24 shows a front and right perspective view of another exemple embodiment of a crib.
Figure 25:
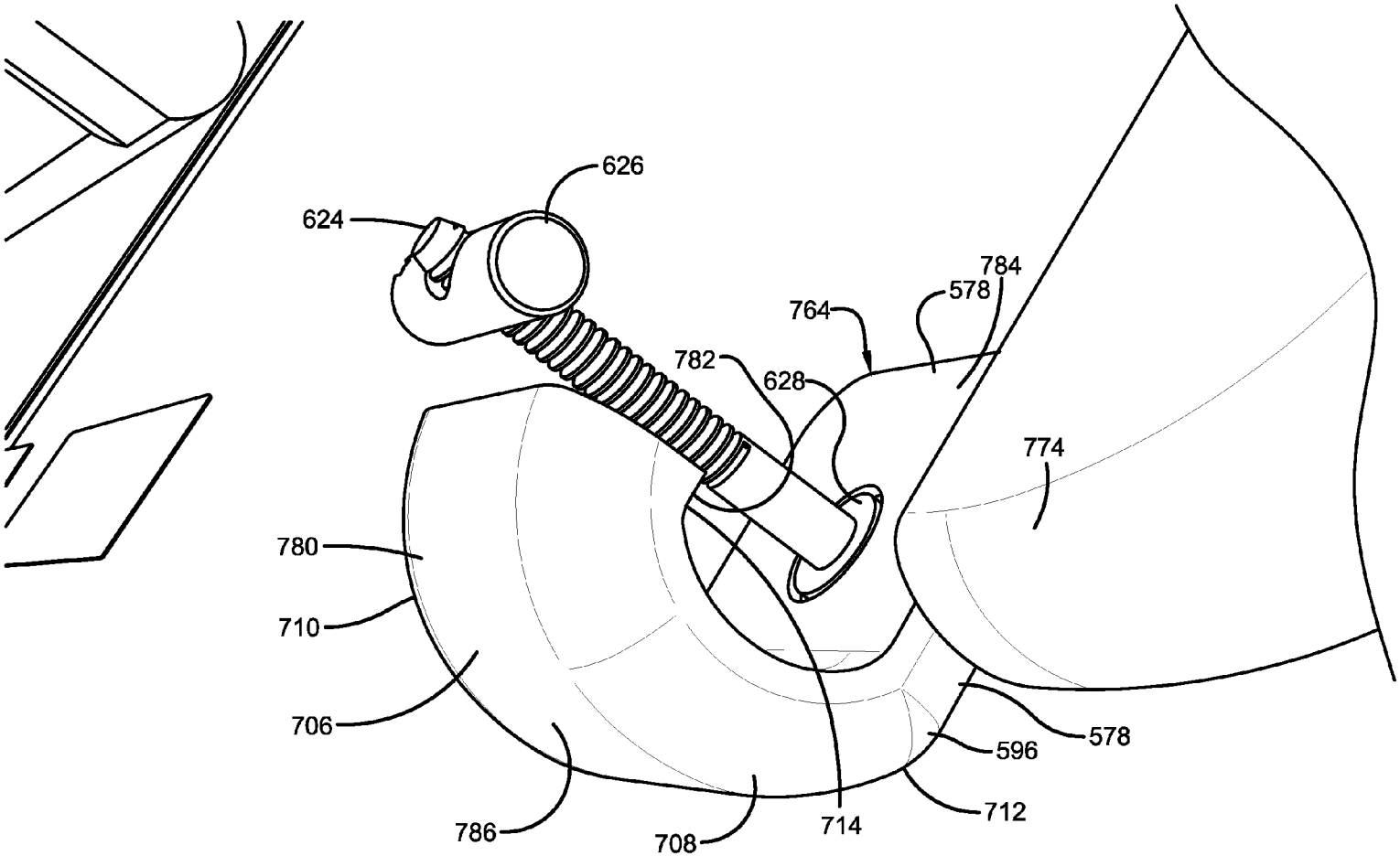
FIG. 25 shows a top perspective view of a portion of the crib of FIG. 24 with portions removed and in phantom to illustrate a bumper and its fastening arrangement.

FIGS. 24-25 show another example embodiment of a crib 700 with bumpers. In this example embodiment, the bumper 764 has a different shape. Referring to FIG. 25, the bumper 764 comprises first and second legs 578, 780 and a lip 782 that define a hook like configuration. The bumper also includes interior and exterior surfaces 784, 786. The first leg 578 is similar in structure and function to the first leg 578 of the bumper 564 of the previous exemplary embodiment. The second leg 780 has a base 706 that is generally partly cylindrical with rounded upper and lower ends 708, 710 at its periphery. In particular, the exterior surface 786 at each of the ends 708, 710 convexly curves radially outwardly from the base 706, and the exterior surface 786 at the base 706 convexly curves from one side end 712 to another side end 714 of the base 706 as viewed in FIGS. 24-25. The second leg 780 extends inwardly from a side end 596 of the first leg 778 of the bumper along the right or left direction (as viewed in FIG. 25).

The lip 782 extends inwardly from the side end 714 of the second leg 780 along the front or rear direction (as viewed in FIG. 25). The interior surface 784 of the lip 782 is flat. The exterior surface of the lip 782 is convexly curved with a contour that blends in with the curved base 706 of the second leg 780 to define an arcuate portion of the bumper 764.

As shown in FIG. 24, the crib may include right and left headboards 756, 757. Each headboard comprises upper, lower, inner, outer, and side faces 766, 768, 770, 772, 774. In this exemplary embodiment, the side face 751 of the vertical member 736 that receives the second leg 780 and the upper and side faces 766, 774 of each headboard is curved to match the curved contour of the second leg 780. The bumper 764 is mounted to the vertical members using the same fastening arrangement as that previously mentioned. The headboards 756, 757 are shaped different to that of FIG. 12 and different casters 758 are provided, but generally other aspects of the crib 700 are similar to the crib 500 of the previous embodiment.

Also, it should be appreciated that the one or more of the described principles and features described herein related to a crib, may be applied to alternative embodiments and configurations of cribs. It is noted that several examples have been provided for purposes of explanation. These examples are not to be construed as limiting the hereto-appended claims. Additionally, it may be recognized that the examples provided herein may be permutated while still falling under the scope of the claims.

What is claimed is:

1. A crib comprising:

at least one wall;

at least one vertical member;

at least one bumper;

wherein the at least one wall, the at least one bumper, and the at least one vertical member are held in operative connection to each other by at least one fastener, wherein the at least one fastener extends into each of the at least one wall, the at least one bumper, and the at least one vertical member; and wherein the at least one bumper is positioned in operative supported connection with the at least one vertical member, wherein the at least one bumper includes an upper peripheral end that extends on at least three sides of the vertical member, wherein the upper peripheral end is convexly curved toward the at least one vertical member, wherein the upper peripheral end is configured to smoothly direct at least one finger of a child contacting the upper peripheral end away from the at least one bumper and the at least one vertical member.

2. The crib according to claim 1, wherein the at least one wall includes at least one horizontal member, wherein the at least one horizontal member, the at least one bumper, and the at least one vertical member are held in operative connection to each other by the at least one fastener, wherein the at least one fastener extends into each of the at least one horizontal member, the at least one bumper, and the at least one vertical member.

3. The crib according to claim 2 and further including at least another bumper, wherein the at least one wall includes at least another horizontal member, wherein the at least another bumper, the at least another horizontal member, and the at least one vertical member are held in operative connection to each other by at least another fastener, wherein the at least another fastener extends into each of the at least another horizontal member, the at least another bumper, and the at least one vertical member.

4. The crib according to claim 2, and further comprising a barrel nut, wherein the barrel nut is operatively engaged with the at least one horizontal member, wherein the at least one fastener includes a bolt, wherein the bolt extends into the at least one bumper, the at least one vertical member, and the at least one horizontal member and engages the barrel nut to hold the at least one bumper, the at least one vertical member, and the at least one horizontal member in operative connection with each other.

5. The crib according to claim 4, and further comprising a bushing, wherein the bolt includes a head and a shaft, wherein the at least one bumper is positioned in operatively supported connection with the at least one vertical member, wherein the shaft extends through the bushing, wherein the bushing is positioned between the head and the at least one vertical member.

6. The crib according to claim 1 wherein the at least one vertical member includes a first face and a second face, wherein the second face extends transverse of the first face, wherein the at least one bumper is positioned in operatively supported connection with the first face of the at least one vertical member and the second face of the at least one vertical member.

7. The crib according to claim 6 wherein the at least one vertical member includes a third face, wherein the third face extends opposite the first face, wherein the at least one bumper is positioned in operative supported connection with the third face.

8. The crib according to claim 1 wherein the at least one vertical member includes at least a first face, wherein the at least one bumper is positioned in operative supported connection with the at least first face of the at least one vertical member, wherein the at least one bumper includes at least a second face opposite the at least first face of the at least one vertical member that has substantially the same contour as the at least first face of the at least one vertical member.

9. The crib according to claim 1 wherein the at least one bumper comprises an elastic material.

10. The crib according to claim 1, including at least another bumper, wherein the at least one wall includes an upper horizontal member and a lower horizontal member, wherein the upper horizontal member, the at least one bumper, and the at least one vertical member are held in operative connection to each other by the at least one fastener, wherein the at least one fastener extends into each of the at least one horizontal member, the at least one bumper, and the at least one vertical member, wherein the at least another bumper, the lower horizontal member, and the at least one vertical member are held in operative connection to each other by at least another fastener, wherein the at least another fastener extends into each of the lower horizontal member, the at least another bumper, and the at least one vertical member.

11. The crib according to claim 1, wherein the bumper includes a recess, wherein the fastener includes a head, wherein the head is position inside the recess.

12. A method comprising:

a) positioning at least one bumper in operative connection with at least one vertical member of a crib, wherein the crib includes at least one wall; and b) extending at least one fastener into each of the at least one bumper, the at least one vertical member, and the at least one wall such that the at least one wall, the at least one bumper, and the at least one vertical member are held in operative connection to each other by the at least one fastener, wherein the at least one bumper is positioned in operative supported connection with the at least one vertical member, wherein the at least one bumper includes an upper peripheral end that extends on at least three sides of the vertical member, wherein the upper peripheral end is convexly curved toward the at least one vertical member, wherein the upper peripheral end is configured to smoothly direct at least one finger of a child contacting the upper peripheral end away from the at least one bumper and the at least one vertical member.

13. The method of claim 12 further comprising:

c) prior to (a) operatively engaging a barrel nut and the at least one wall, wherein (b) includes engaging the at least one fastener and the barrel nut to hold the at least one bumper, the at least one vertical member, and the at least one horizontal member in operative connection with each other.

14. The method according to claim 13, wherein a bore extends through the at least one vertical member and into the at least one wall, wherein (a) includes aligning a hole in the barrel nut and the bore, wherein (b) includes extending the at least one fastener into the bore and at least partially into the hole of the barrel nut.

15. The method of claim 13 further comprising:

c) prior to (a) positioning a bushing between the at least one bumper and the at least one vertical member, wherein (b) further comprises extending the at least one fastener into the bushing.

16. The method according to claim 12, wherein the at least one vertical member includes a first face and a second face, wherein the second face extends transverse of the first face, wherein (a) includes positioning the at least one bumper in operatively supported connection with the first face of the at least one vertical member and the second face of the at least one vertical member.

17. The method according to claim 16 wherein the at least one vertical member includes a third face wherein the third face extends opposite the first face, wherein (a) includes positioning the at least one bumper in operatively supported connection with the third face.

18. An apparatus comprising:

at least one bumper, wherein the at least one bumper is configured to be operatively connected to a crib, wherein the crib includes at least one wall and at least one vertical member; and wherein the at least one wall, the at least one bumper, and the at least one vertical member are held in operatively fixed connection by at least one fastener, wherein the at least one fastener extends into each of the at least one wall, the at least one bumper, and the at least one vertical member, wherein the at least one bumper is positioned in operative supported connection with the at least one vertical member, wherein the at least one bumper includes an upper peripheral end that extends on at least three sides of the vertical member, wherein the upper peripheral end is convexly curved toward the at least one vertical member, wherein the upper peripheral end is configured to smoothly direct at least one finger of a child contacting the upper peripheral end away from the at least one bumper and the at least one vertical member.

19. The apparatus according to claim 18 wherein the at least one bumper is comprised of an elastic material.

20. The apparatus according to claim 19, and further comprising a bushing, wherein the at least one fastener includes a bolt, wherein the bolt includes a head and a shaft, wherein the at least one bumper is configured to be positioned in operatively supported relationship with the at least one vertical member, wherein the shaft extends into the at least one wall, the at least one bumper, and the at least one vertical member, wherein the shaft extends through the bushing, wherein the bushing is configured to be positioned between the head and the at least one vertical member.

* * * * *